US008109518B2

(12) United States Patent
Blagg et al.

(10) Patent No.: US 8,109,518 B2
(45) Date of Patent: Feb. 7, 2012

(54) GAME APPARATUS AND METHOD OF USING THE SAME

(75) Inventors: Benjamin J. Blagg, Carrollton, TX (US); Janice E. Ritter, Redondo Beach, CA (US); Stephen Pang Kwai Lau, Torrance, CA (US); Sammy Wai Nang Lam, Kowloon (HK)

(73) Assignee: Mattel, Inc., El Segundo, CA (US)

( * ) Notice: Subject to any disclaimer, the term of this patent is extended or adjusted under 35 U.S.C. 154(b) by 803 days.

(21) Appl. No.: 11/758,470

(22) Filed: Jun. 5, 2007

(65) Prior Publication Data

US 2007/0284825 A1 Dec. 13, 2007

Related U.S. Application Data

(60) Provisional application No. 60/812,154, filed on Jun. 9, 2006, provisional application No. 60/888,735, filed on Feb. 7, 2007.

(51) Int. Cl.
*A63B 63/00* (2006.01)

(52) U.S. Cl. ..... 273/368; 273/317; 273/336; 273/337; 273/338; 273/343; 273/348; 273/354; 273/357; 273/359; 273/369; 273/370; 273/405; 273/407; 446/308; 446/309; 463/4; 463/49; 463/52; 473/503; 473/514

(58) Field of Classification Search ..... 273/317, 273/336, 337, 338, 343, 348, 354, 357, 359, 273/368, 369, 370, 405, 407; 446/308, 309; 463/4, 49, 52; 473/503, 514
See application file for complete search history.

(56) References Cited

U.S. PATENT DOCUMENTS

| | | | | | |
|---|---|---|---|---|---|
| 1,440,454 | A | * | 1/1923 | Ganthier | 446/309 |
| 1,480,563 | A | * | 1/1924 | Morgan | 273/339 |
| 1,523,989 | A | * | 1/1925 | Wright | 273/343 |
| 1,547,273 | A | * | 7/1925 | Trayers | 273/339 |
| 1,719,460 | A | * | 7/1929 | Armbrecht | 273/337 |
| 1,896,591 | A | * | 2/1933 | Plunkett | 273/393 |
| 2,068,200 | A | * | 1/1937 | Shetler | 273/337 |
| 2,073,324 | A | * | 3/1937 | Stockton | 273/339 |
| D135,377 | S | * | 3/1943 | Cameron | D21/303 |
| 2,365,513 | A | * | 12/1944 | Bartle et al. | 273/339 |

(Continued)

FOREIGN PATENT DOCUMENTS

GB 2374812 A 10/2002

(Continued)

OTHER PUBLICATIONS

Printout of webpage at www.amazon.com/Pressman-Toy-2656-Jumpin-Monkeys/dp/B00004TFZH, dated Aug. 8, 2008, 9 pages.

(Continued)

*Primary Examiner* — Gene Kim
*Assistant Examiner* — Alexander R Niconovich
(74) *Attorney, Agent, or Firm* — Edell, Shapiro & Finnan LLC

(57) ABSTRACT

The present disclosure is directed to a game in which players launch, shoot, or propel objects at a target, and more specifically, to a game in which players launch, shoot, or propel objects in an attempt to attach the objects to a target that may be in motion, or to dislodge objects that are hanging from the target.

38 Claims, 22 Drawing Sheets

U.S. PATENT DOCUMENTS 2,382,146 A * 8/1945 Hamilton ..... 273/343
2,584,260 A * 2/1952 Custer ..... 473/591
2,664,077 A * 12/1953 Moore ..... 124/16
D173,641 S * 12/1954 Coleman ..... D21/304
2,793,861 A * 5/1957 Konopka ..... 273/337
2,964,875 A * 12/1960 Bailey ..... 446/314
3,036,834 A * 5/1962 Zalkind ..... 273/271
3,232,285 A * 2/1966 Rasner ..... 124/21
3,381,962 A * 5/1968 Leigh ..... 273/348.3
3,414,265 A * 12/1968 Marks ..... 273/156
D213,123 S * 1/1969 Anderson et al. ..... D21/386
3,421,762 A * 1/1969 Paradise ..... 273/339
3,507,496 A * 4/1970 Miller ..... 273/339
3,525,318 A * 8/1970 Kohner et al. ..... 124/7
3,526,087 A * 9/1970 Soriano et al. ..... 368/101
3,526,991 A * 9/1970 Goldfarb et al. ..... 446/177
D219,822 S * 2/1971 Rockaitis ..... D21/387
3,578,320 A * 5/1971 Goldfarb et al. ..... 273/459
3,589,724 A * 6/1971 Barlow et al. ..... 273/440
3,595,578 A * 7/1971 Burcenski ..... 273/343
3,675,924 A * 7/1972 Smith ..... 273/337
3,701,531 A * 10/1972 Bowers ..... 273/343
3,710,455 A * 1/1973 Liversidge et al. ..... 434/259
3,760,511 A * 9/1973 Matsumoto ..... 434/259
3,762,710 A * 10/1973 De Coninck ..... 473/591
3,774,911 A * 11/1973 Benfield ..... 273/343
3,774,912 A * 11/1973 Glass et al. ..... 273/336
3,810,625 A * 5/1974 Gulling ..... 273/338
3,862,758 A * 1/1975 McLamb ..... 273/393
3,961,794 A * 6/1976 Goldfarb et al. ..... 273/273
3,977,678 A * 8/1976 Hedberg ..... 273/336
4,109,914 A * 8/1978 Matsumoto ..... 273/354
4,132,410 A * 1/1979 Montagna ..... 273/339
4,147,355 A * 4/1979 Barlow et al. ..... 463/52
4,177,992 A * 12/1979 Todokoro ..... 273/357
4,257,601 A * 3/1981 Kurita ..... 273/115
D264,483 S * 5/1982 Raymond ..... D21/304
4,458,902 A * 7/1984 Miller et al. ..... 473/591
4,491,327 A * 1/1985 Morris ..... 273/343
4,501,427 A * 2/1985 Payne ..... 273/406
4,583,743 A * 4/1986 Macek ..... 273/368
4,726,591 A * 2/1988 Johnson ..... 273/339
4,744,566 A * 5/1988 Malavazos et al. ..... 273/357
4,763,898 A * 8/1988 Hemmann ..... 273/153 R
4,784,387 A * 11/1988 Liversidge ..... 273/456
4,804,192 A * 2/1989 Matsumoto et al. ..... 273/336
4,966,373 A * 10/1990 Houle et al. ..... 273/339
4,988,099 A * 1/1991 Kuna et al. ..... 273/445
5,165,694 A * 11/1992 Kraushaar ..... 273/343
5,690,330 A * 11/1997 Ozawa ..... 273/108.56
5,692,979 A * 12/1997 Jones ..... 473/470
5,887,872 A * 3/1999 Keifer et al. ..... 273/273
5,954,337 A * 9/1999 Cunningham ..... 273/338
6,135,455 A * 10/2000 McNally ..... 273/338
6,168,160 B1 * 1/2001 DeOreo et al. ..... 273/374
6,398,618 B1 * 6/2002 Wu ..... 446/330
6,439,570 B2 * 8/2002 Rossi et al. ..... 273/108.1
6,468,126 B1 * 10/2002 Herber ..... 446/310
6,557,855 B2 * 5/2003 Wu ..... 273/369
D481,763 S * 11/2003 Roy ..... D21/304
7,004,468 B2 * 2/2006 Johnson et al. ..... 273/343
7,140,945 B2 * 11/2006 Dinhofer ..... 446/378
2002/0094748 A1 * 7/2002 Baik ..... 446/227
2002/0158412 A1 10/2002 We
2004/0092201 A1 * 5/2004 Schoonmaker ..... 446/153
2004/0239035 A1 * 12/2004 Lambert et al. ..... 273/348
2005/0001381 A1 * 1/2005 Lambert et al. ..... 273/348
2005/0006846 A1 * 1/2005 Roy ..... 273/336
2005/0279794 A1 * 12/2005 Gerchen ..... 224/576
2007/0284825 A1 * 12/2007 Blagg et al. ..... 273/359

FOREIGN PATENT DOCUMENTS

JP 06091027 A 4/1994
JP 10005442 A 1/1998
JP 2001000609 A 1/2001
JP 2003230647 A 8/2003
JP 2005013672 A 1/2005

OTHER PUBLICATIONS

Printout of webpage at www.boardgamegeek.com/game/7462, dated Aug. 8, 2008, 3 pages.
Printout of webpage at www.amazon.com/Mattel-52563-Tumblin-Monkeys/dp/B00007F8Q0, dated Aug. 8, 2008, 9 pages.
Notification of the First Office Action and Text of the First Office Action from Chinese Patent Application No. 200710108985.X, dated Jun. 18, 2010, 8 pages.
Search Report and Written Opinion from French Patent Application No. 0755621, dated Mar. 2010, 5 pages.
Search and Examination Report from British Patent Application No. GB0710978.8, dated Sep. 14, 2007, 3 pages.

* cited by examiner

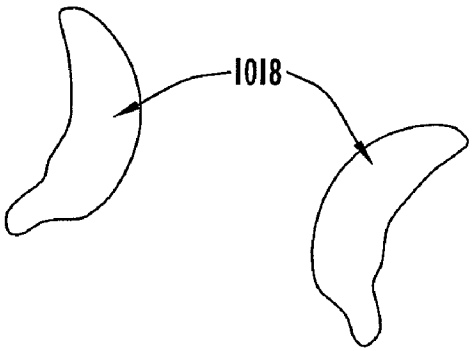
FIG.32
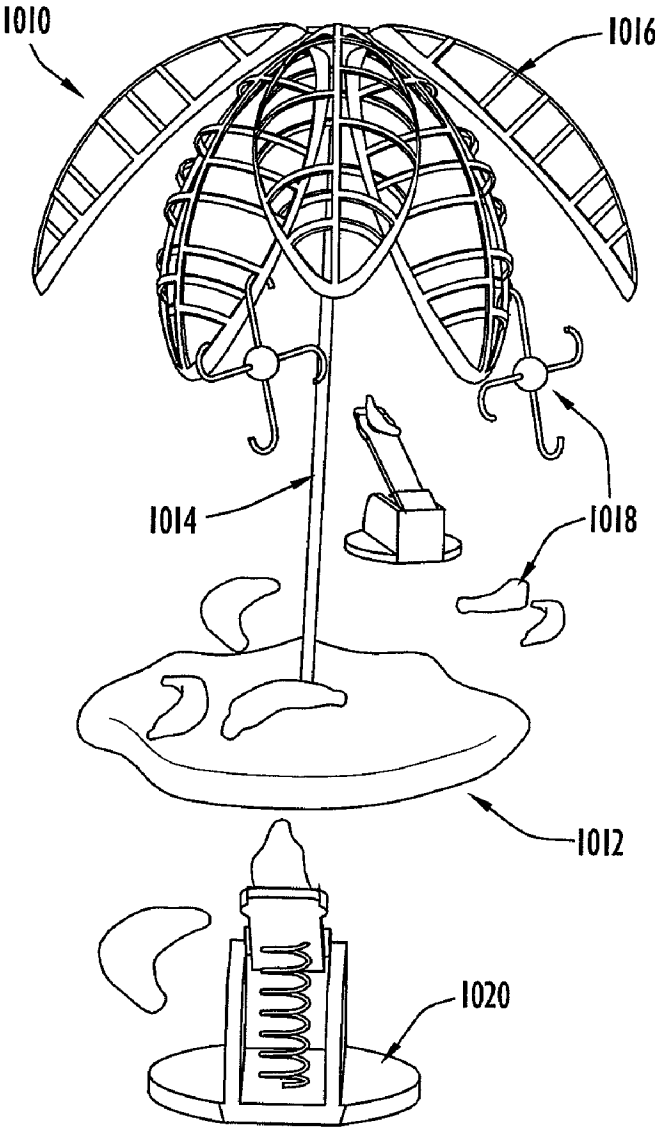
FIG.31
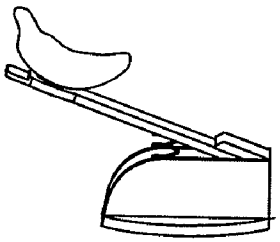

GAME APPARATUS AND METHOD OF USING THE SAME

RELATED APPLICATION

This application claims the benefit of U.S. Provisional Patent Application No. 60/812,154, entitled "Game Apparatus and Method of Using the Same," filed Jun. 9, 2006, the disclosure of which is incorporated herein by reference in its entirety for all purposes. This application also claims the benefit of U.S. Provisional Patent Application No. 60/888,735, entitled "Game Apparatus and Method of Using the Same," filed Feb. 7, 2007, the disclosure of which is incorporated herein by reference in its entirety for all purposes.

BACKGROUND OF THE INVENTION

Games involving launching objects into the air at a target are popular with children. Children enjoy toys that spin, bounce, vibrate, or otherwise move. In some conventional games involving launching objects at a target, the target typically has been stationary. Often, the game was over when all the objects had been thrown at the target. Further, those games did not differentiate between various objects caught in the target, and if an object was caught, and unless another object knocked it down, it stayed in the target.

SUMMARY OF THE INVENTION

The present disclosure is directed to a game in which players launch, shoot, or propel objects at a target, and more specifically, to a game in which players launch, shoot, or propel objects in an attempt to attach the objects to a target that may be in motion, or to dislodge objects that are hanging from the target.

In one implementation of a game according to the invention, each player is given an equal amount of projectile objects and a launcher or launching mechanism. The players simultaneously begin launching their objects at a target or target assembly. Depending on the particular game being played, the players attempt to hook or catch their objects on the target and/or knock already hanging objects of other players off the target. While players are launching their objects at the target, the target may be rotating, spinning, bouncing, swaying, or in some similar form of motion, making it more difficult to hit the target. The motion of the target may be constant or in intermittent intervals. The target may be provided with a delay mechanism, such as a suction device and/or a spring or biasing mechanism, such that when the delay mechanism operates, the target may make a sudden movement, which may dislodge some objects from the target.

The games of the present disclosure will be understood more readily after a consideration of the drawings and Detailed Description.

BRIEF DESCRIPTION OF THE DRAWINGS

FIG. 31 is a perspective view of the target shown in FIGS. 29-30, showing projectile objects hanging from the target areas and resting on the launching devices.

FIG. 32 is a perspective view of projectile objects in the form of bananas in accordance with an embodiment of the present disclosure, showing opposing sides of the projectile objects resembling bananas.

DETAILED DESCRIPTION

A toy game comprises a target or target assembly and at least one object that can be launched or propelled toward the target. The target can be mounted for movement in several directions, thereby changing the level of difficulty of game play using the target. For example, the target can rotate, sway back and forth, be raised up, and be lowered down. The target can move during game play. The toy game can include a timing element which causes the target to move after a certain period of time has elapsed. For example, the target can pop upwardly after the period of time has elapsed, thereby causing some of the objects on the target to disengage from the target.

The terms "target" and "target assembly" are used interchangeably to refer to a structure at which an object can be launched or propelled. The terms "launcher" and "launching mechanism" are used interchangeably to refer to a device that can be actuated by a user to launch or propel an object in a particular direction. The term "object" may be used interchangeably with "launching object" and "projecting object" and is intended to refer to an item that can be launched, propelled, or shot into the air in a particular direction. The terms "shaft," "support," and "support member" are used interchangeably herein. The terms "movable element" and "movable member" are used to refer to an element that can move in one or more directions. Several examples of movable elements or members are described herein.

Figure 1:
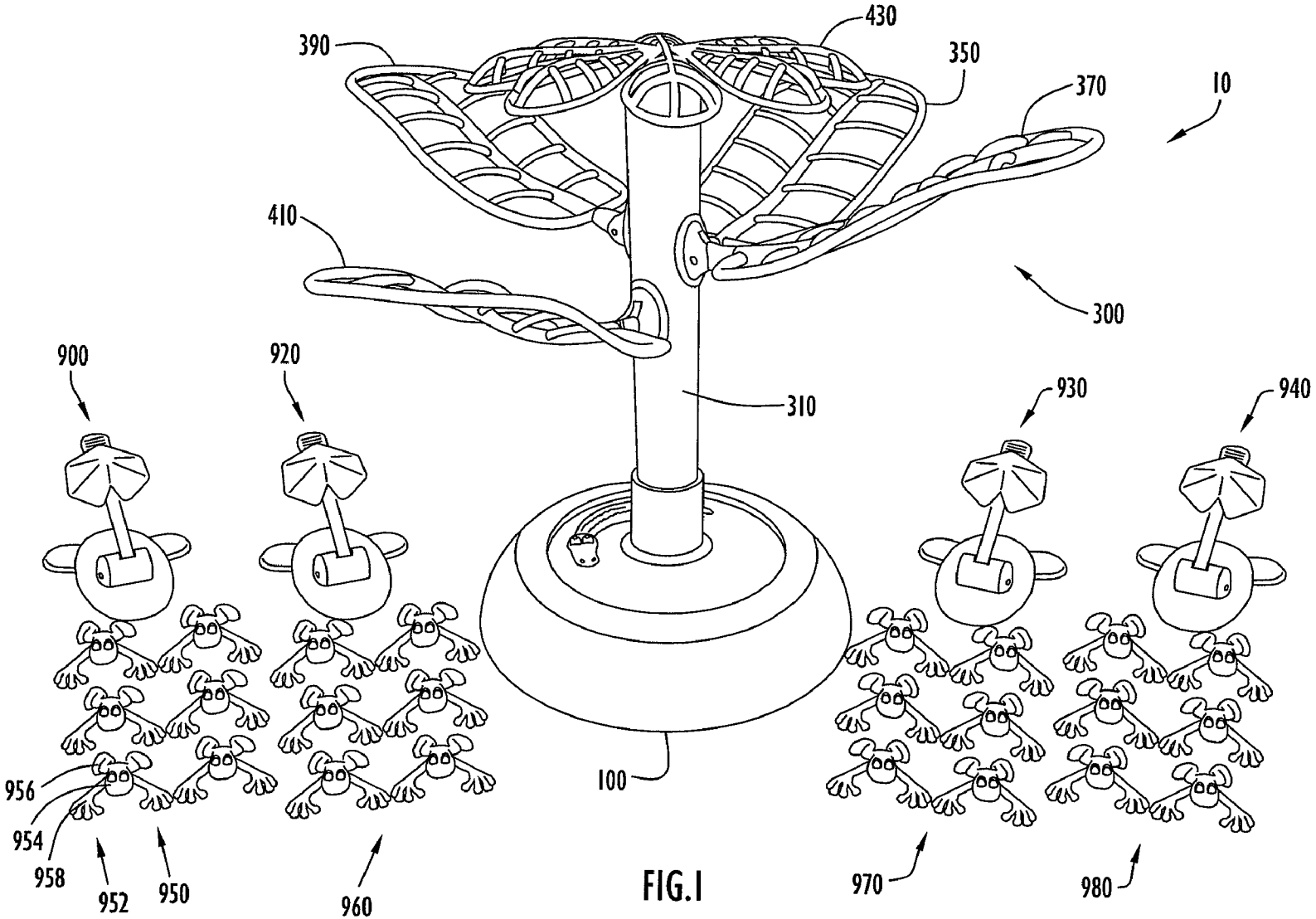
FIG. 1 is a front perspective view of an embodiment of a game according to the present invention.

A toy game 10 according to an embodiment of the invention is illustrated in FIG. 1. In this embodiment, the game 10 includes a base 100 and a target or target assembly 300. The game 10 also includes several sets of playing objects that can be used with the base 100 and the target assembly 300.

In this embodiment, the game 10 includes several launchers or launching mechanisms 900, 920, 930, and 940 that can be launched. Each of the launching mechanisms is in the shape of a lily pad and is made of a plastic material and can be of a different color than the other launching mechanisms, thereby facilitating the distinctions between them. The game 10 also includes several groups of objects 950, 960, 970, and 980. Each object in a particular group matches the other objects in that group. For example, each object is made of a plastic material can be color-coded to match a color of a particular launching mechanism.

Referring to FIG. 1, one of the objects 950 is described in greater detail. Object 952 includes a body 954 with arms 956 and legs 958. Arms 956 and legs 958 extend from the body 954 and form catches or hook-like structures can engage a portion of the target assembly 300 so that the object 952 is supported on the target assembly 300. In this embodiment, the objects are formed to resemble frogs. In other embodiments, the shape and/or configuration of the objects can vary. For example, the objects can be formed to resemble other animals, such as monkeys. In alternative embodiments, the launching mechanisms and the projectile objects can be formed of different materials and may include distinguishing characteristics other than color. Also, the quantity of objects that are in a group associated with a particular launching mechanism can vary.

In the embodiment illustrated in FIG. 1, the target assembly 300 is formed to resemble a tree-like structure that includes branches. As shown, the target assembly 300 includes a support 310 that resembles a tree trunk with a top or upper portion 430 and several target areas of branches 350, 370, 390, and 410. Each of the upper portion 430 and the branches 350, 370, 390, and 410 forms a target or target area at which the objects 950, 960, 970, and 980 can be launched or projected.

During operation of the game 10, a player places an object, such as object 952, on launching mechanism 900 and actuates the launching mechanism 900 to propel the object 952 toward the upper portion 430 or one of the branches 350, 370, 390, and 410. As will be described in greater detail below, each player can attempt to get as many of that player's objects onto the upper portion 430 and the branches 350, 370, 390, and 410 before the game ends. The player with the most objects remaining on the target 300 at the end of the game is the winner. Each player may also attempt to launch objects at the target 300 to knock the objects of the other players off the target 300. Each of these components as well as different modes of operation will be described in greater detail below.

Figure 2:
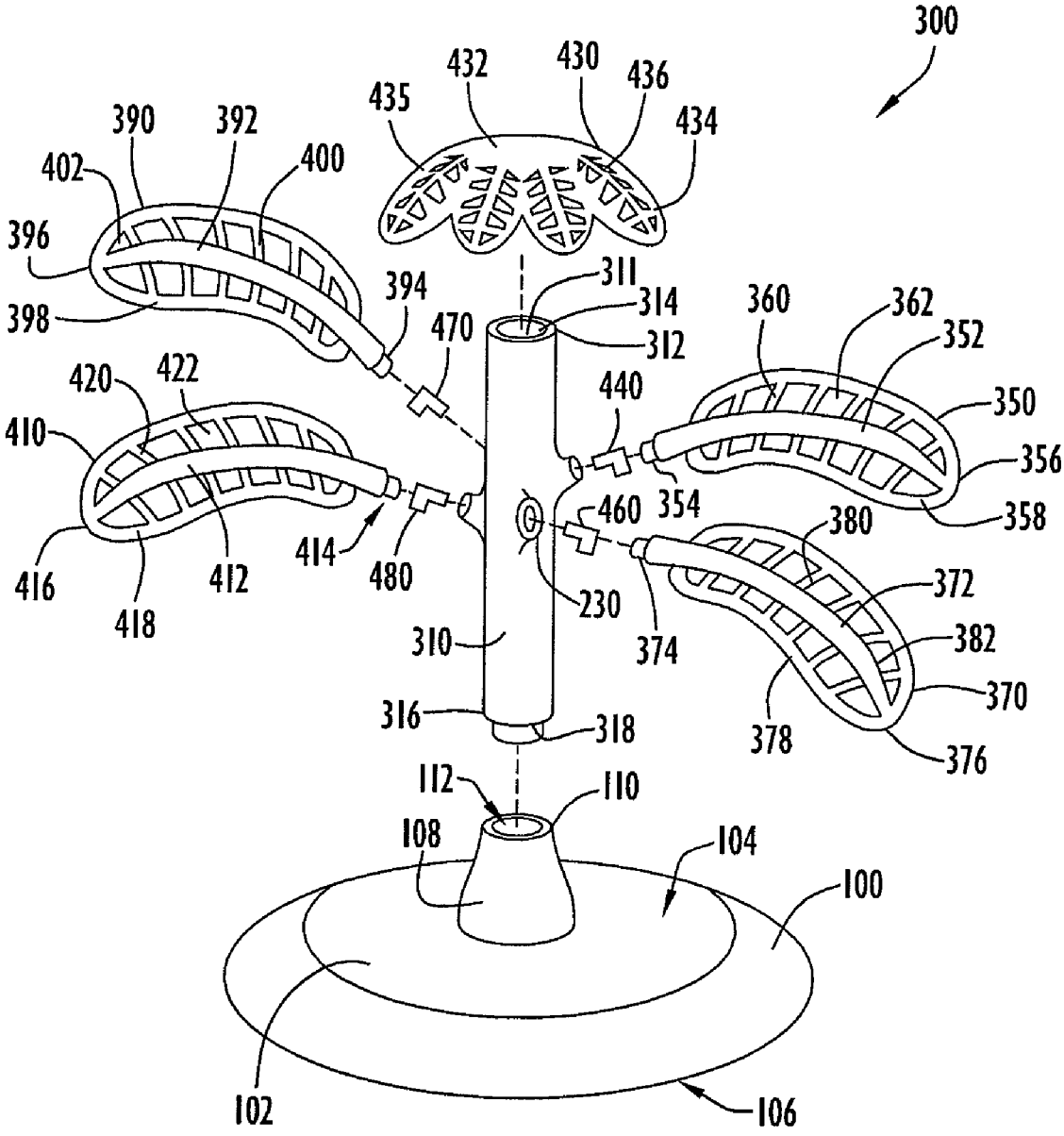
FIG. 2 is an exploded perspective view of some of the components of the game illustrated in FIG. 1.

Referring to FIG. 2, an exploded perspective view of target assembly 300 is illustrated. In this embodiment, the target assembly 300 includes a base 100 and a shaft or support 310 that can be coupled to the base 100. In one embodiment, support 310 is elongate and can be referred to as an elongate support or a support member.

Base 100 includes a housing 102 with an upper portion 104 and a lower portion 106 that are coupled together. A projection 108 extends upwardly from the upper surface of the upper portion 104. The projection 108 has an upper end 110 with an opening 112 formed therein. The opening 112 is in communication with the interior of the housing 102 where a drive mechanism (discussed in detail below) is located. While the projection 108 resembles a bottom portion of a tree trunk, in alternative embodiments, the projection 108 can have any size or configuration.

Support 310 includes a first end 312 and an opposite, second end 316. In the orientation illustrated in FIG. 2, the first end 312 can be referred to as an upper end and the second end 316 can be referred to as a lower end. The support 310 includes a coupling element or coupler 314 proximate the first end 312. The support 310 also includes a coupling element or coupler 318 proximate the second end 316. End 316 of the support 310 is configured to be inserted into the opening 112 in the projection 108. When end 316 is inserted into the projection 108, the support 310 is supported on the base 100.

The target assembly 300 includes several targets or target areas coupled to the support 310. In particular, target areas 350, 370, 390, and 410 are coupled to the support 310. As described below, support 310 and target areas 350, 370, 390, and 410 move and each can be referred to as a movable member or element.

Target area 350 includes a body portion 352 that extends from a proximal or mounting end 354 to a distal end 356. A perimeter member 358 extends between ends 354 and 356 and on both sides of the body portion 352. Several ribs or bars 360 extend between the body portion 352 and the perimeter member 358 and define openings 362 therebetween. Similarly, target areas 370, 390, and 410 respectively include body portions 372, 392, and 412 with ends 374, 376, 394, 396, 414, and 416, perimeter members 378, 398, and 418, bars 380, 400, and 420, that define openings 382, 402, and 422. Each of the target areas 350, 370, 390, and 410 is coupled to the support 310 proximate its respective mounting end 354, 374, 394, and 414.

Figure 19:
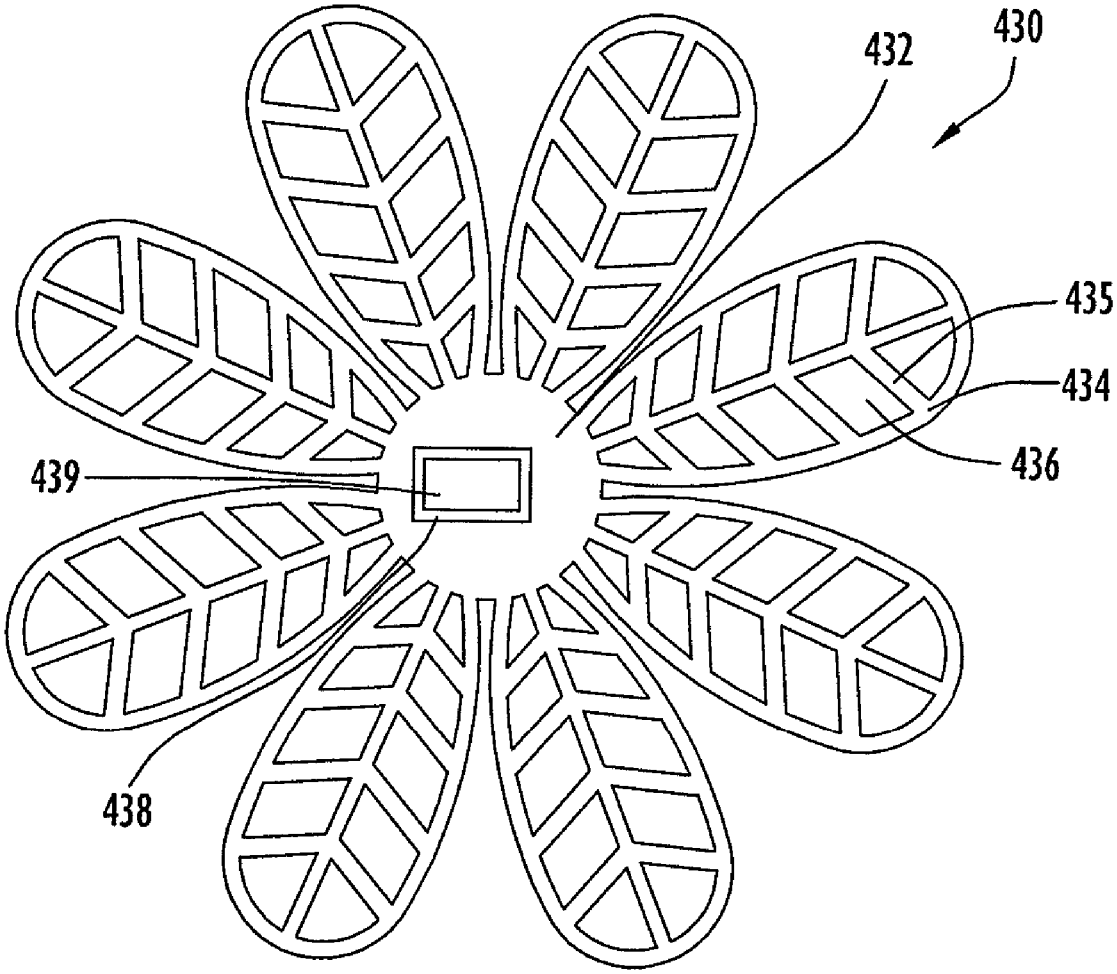
FIG. 19 is a bottom view of an embodiment of a target portion of the game illustrated in FIG. 1.

The target assembly 300 includes a target area 430 disposed proximate to end 312 of the support 310. The coupling element 314 of the support 310 is configured to cooperate with a portion of the target area 430 to couple the target area 430 to the support 310. The target area 430 includes a solid center portion 432 with a surrounding body portion 434 that includes several ribs 435 that define openings 436 therebetween. Referring to FIG. 19, a bottom view of an embodiment of the target area 430 is illustrated. Target area 430 includes a wall 438 that defines a receptacle 439. The wall 438 is configured to be inserted in the receptacles located at the upper ends of the support portions 500 and 530 when they are coupled together.

The target areas 350, 370, 390, 410, and 430 are formed of plastic and other than target area 430 are substantially the same size and configuration. In alternative embodiments, the target areas may be of any material other than plastic that provides sufficient strength and support to be a target. Moreover, the target areas can have different sizes and/or configurations.

In this embodiment, the target assembly 300 also includes several couplers that are used to mount or couple the target areas 350, 370, 390, and 410 to the support 310. The couplers allow the target areas to move relative to the support. Each of the couplers is coupled at one end to a target area and is movably coupled to the support 310. As each coupler moves relative to the support 310, the target area connected to the coupler also moves.

As illustrated in FIG. 2, target area 350 is mounted to coupler 440, target area 370 is mounted to coupler 460, target area 390 is mounted to coupler 470, and target area 410 is mounted to coupler 480. The couplers will be discussed in greater detail below.

Figure 3:
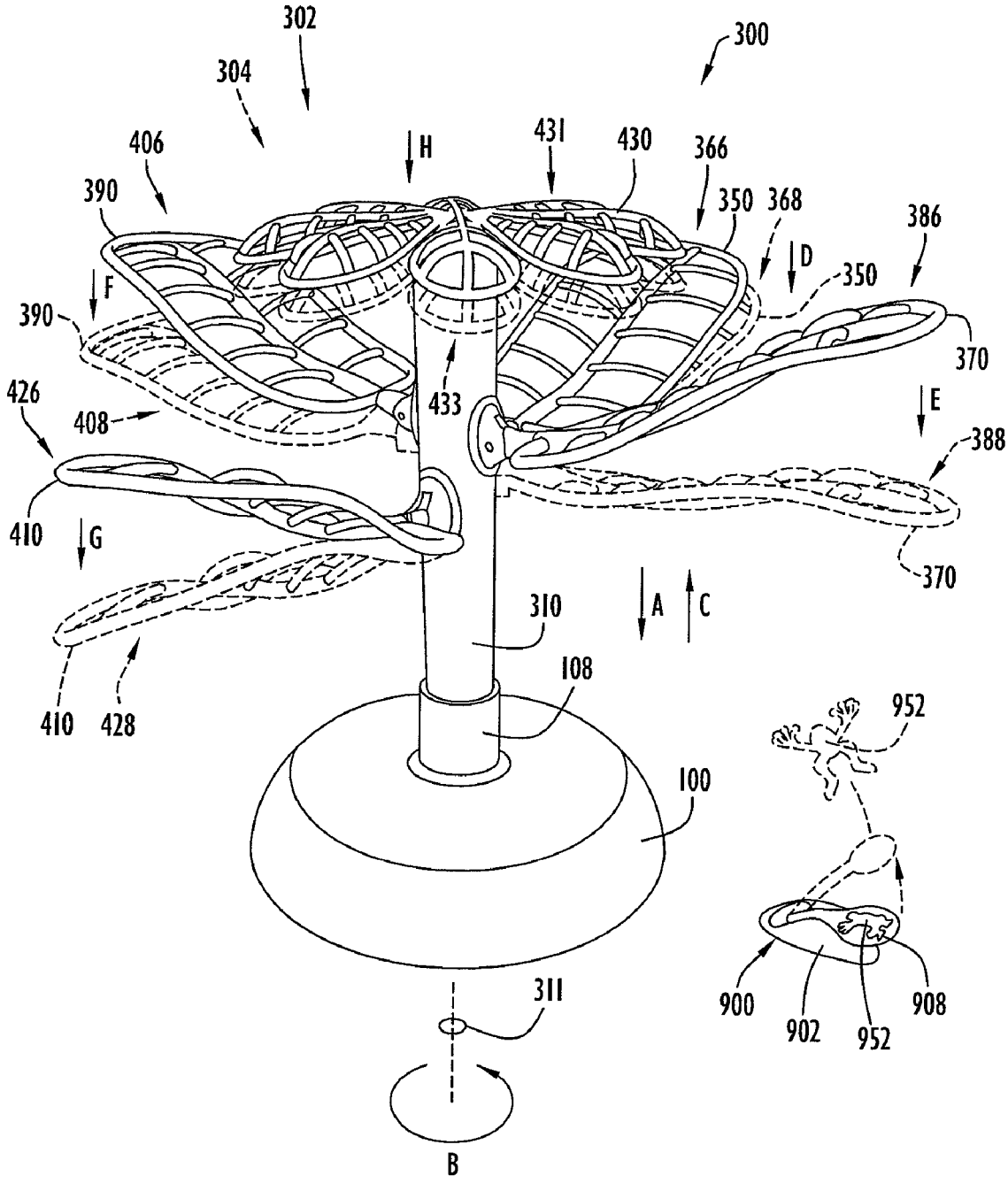
FIG. 3 is a perspective view of some of the components of the game illustrated in FIG. 1 in different configurations.

Referring to FIG. 3, the different configurations in which the target assembly 300 can be disposed are illustrated. A rest or non-operating configuration 302 of the target assembly 300 is illustrated in solid lines. A deployed or operating configuration 304 of the target assembly 300 is illustrated in dashed lines. The target areas 350, 370, 390, and 410 can extend in directions that are substantially perpendicular to the support 310. In other embodiments, the directions in which those components extend can vary.

As illustrated in FIG. 3, the support 310 and the target areas 350, 370, 390, 410, and 430 are in different positions depending on the configuration of the target assembly 300. The target assembly 300 and in particular, the support 310, is moved from its position in its first configuration 302 along the direction of arrow "A" to a position in its second configuration 304. Such movement of the support 310 moves the support 310 toward the base 100 in a substantially linear manner. In this embodiment, the support 310 has a longitudinal axis 311. During operation of the game, the support 310 rotates about its longitudinal axis 311 along the direction of arrow "B." In another embodiment, the support may rotate about an axis offset from its longitudinal axis.

During operation of the game, the support 310 moves from its position in its second configuration 304 along the direction of arrow "C" to its position in its first configuration 302. In that direction, the support 310 and the components coupled to it move away from the base 100.

When the support 310 and target assembly 300 is in the first configuration 302, target areas 350, 370, 390, 410, and 430 are in their respective first positions 366, 386, 406, 426, and 431. As the support 310 moves along the direction of arrow "A," target area 350 moves along the direction of arrow "D" from its first position 366 to its second position 368. Similarly, target area 370 moves along the direction of arrow "E" from its first position 386 to its second position 388, target area 390 moves along the direction of arrow "F" from its first position 406 to its second position 408, target area 410 moves along the direction of arrow "G" from its first position 426 to its second position 428, and target area 430 moves along the direction of arrow "H" from its first position 431 to its second position 433. When the support 310 moves upwardly along the direction of arrow "C," each of the target areas 350, 370, 390, 410, and 430 moves away from the base 100 from its respective second position to its respective first position. In this embodiment, each of the target areas 350, 370, 390, 410, and 430 moves substantially simultaneously with the movement of the support 310. The movements of these components is described in greater detail below.

Figure 4:
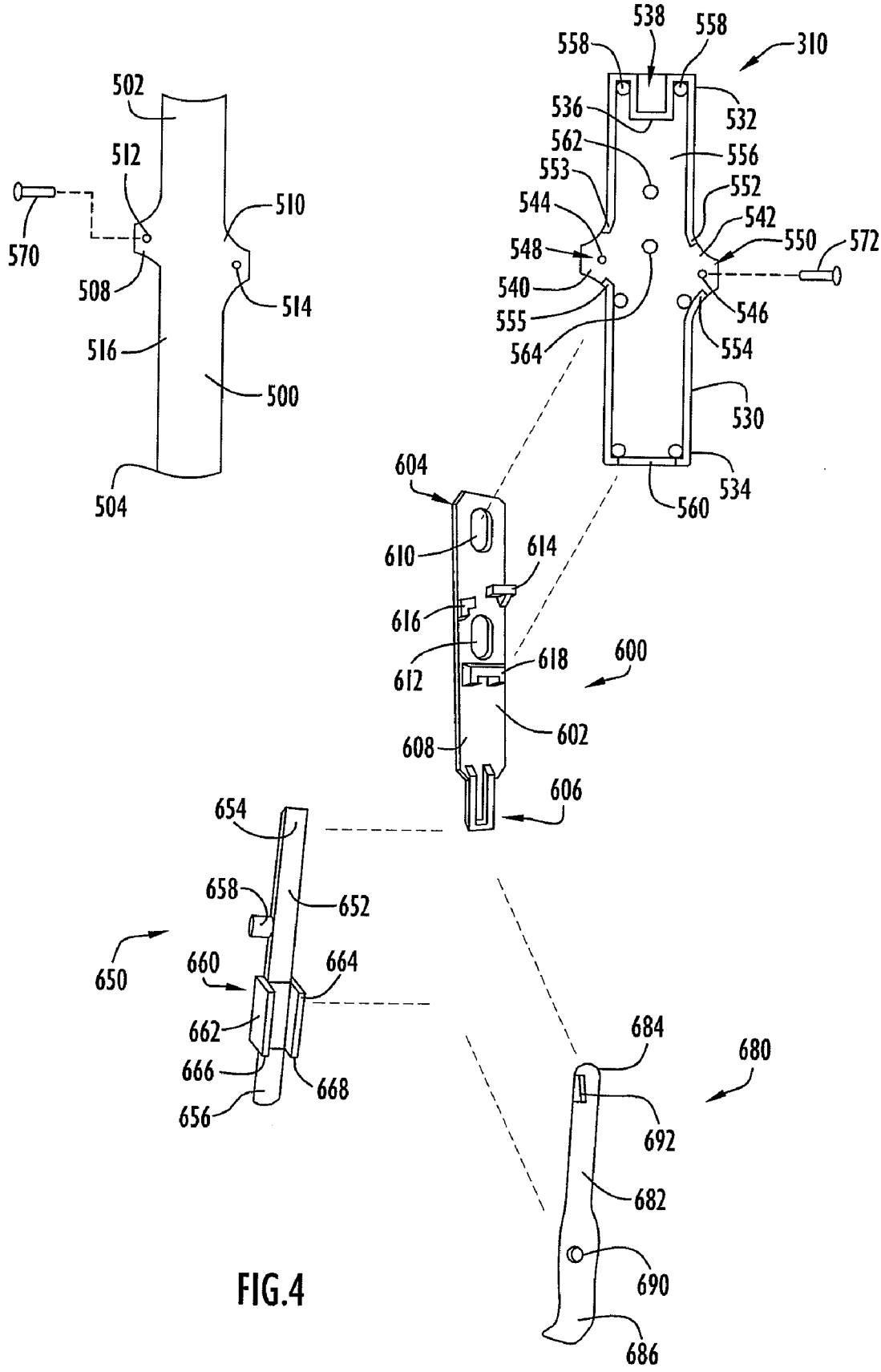
FIG. 4 is an exploded perspective view of the some of the components of the support of the game illustrated in FIG. 1.
Figure 5:
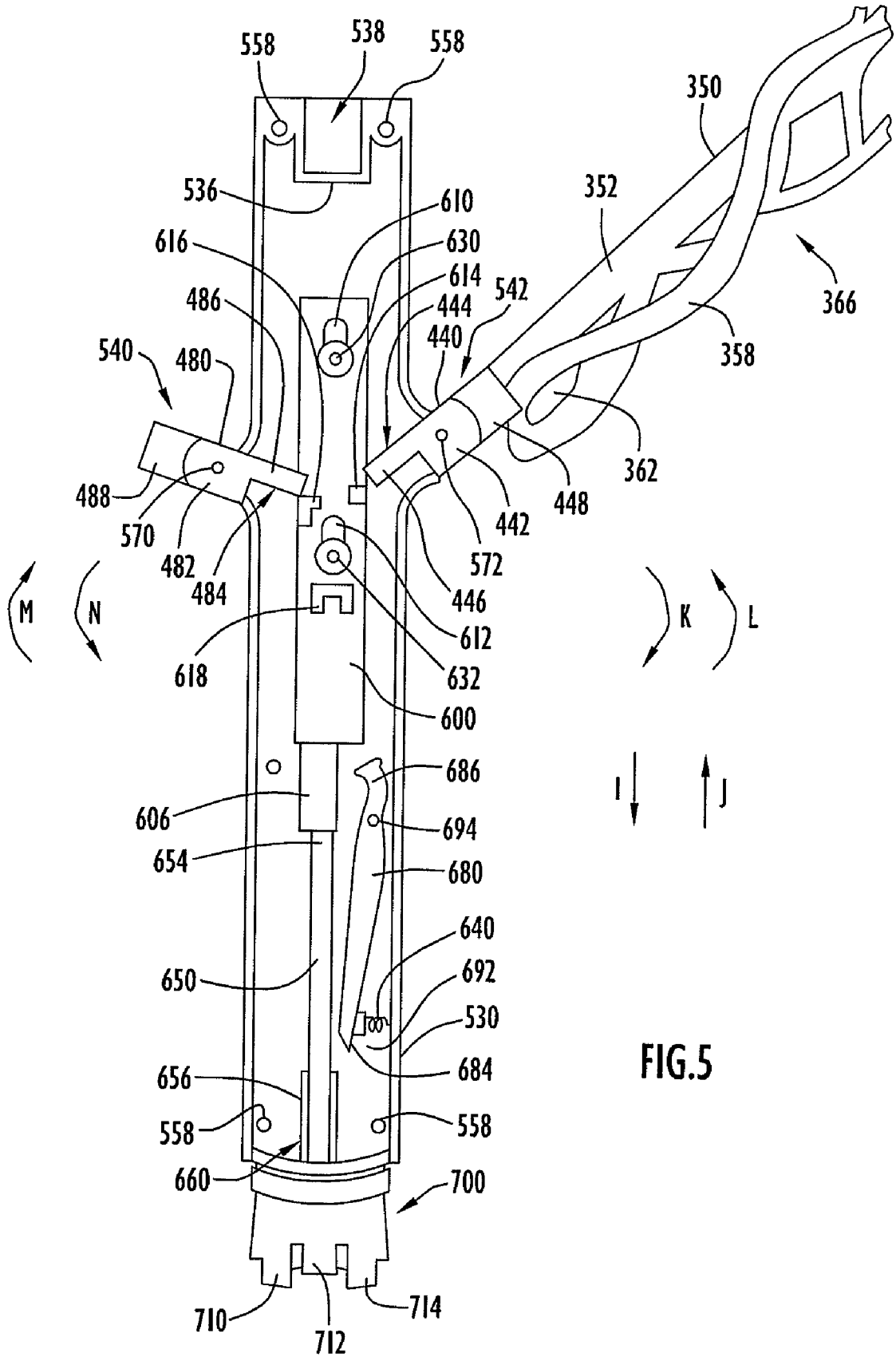
FIG. 5 is an internal view of some of the components of the game illustrated in FIG. 1.
Figure 6:
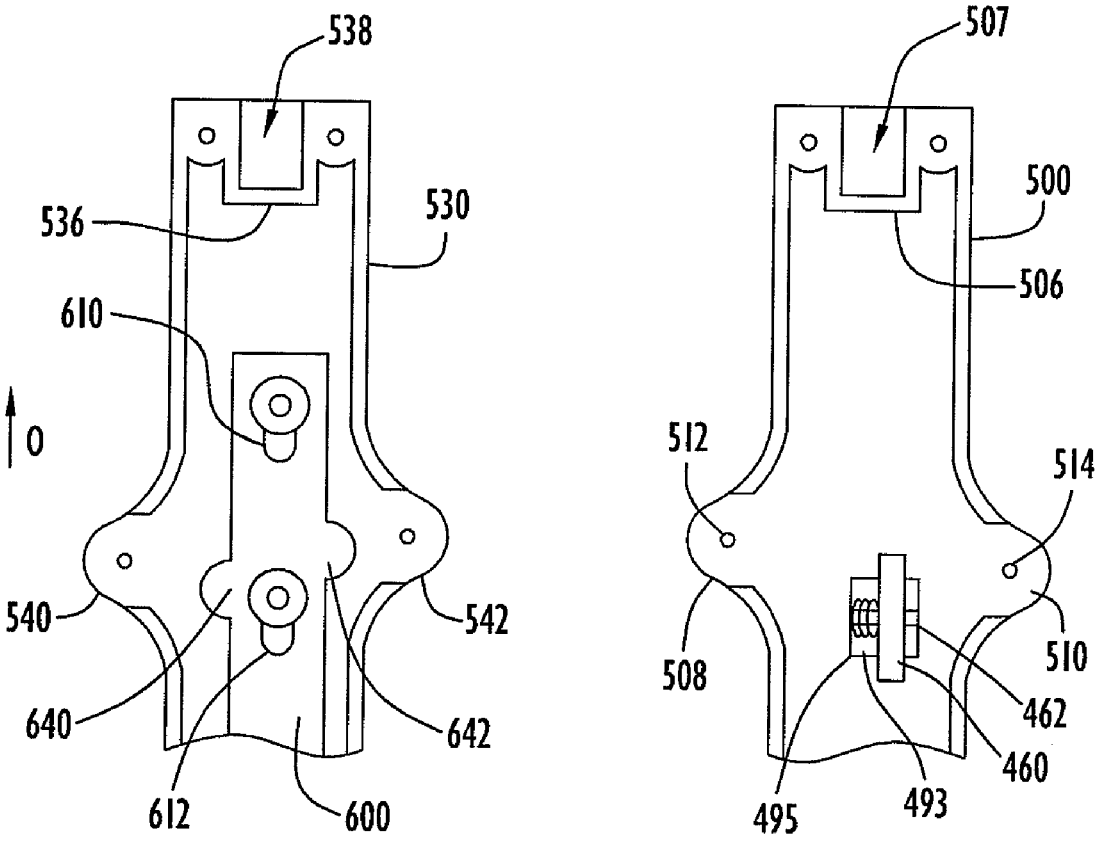
FIG. 6 is a partial internal view of some of the components illustrated in FIG. 5.

Referring to FIGS. 4-6, some of the components of the support that cause relative movement of some of the components of the game are illustrated. In this embodiment, the support 310 includes two support portions 500 and 530 that can be coupled together. Support portions 500 and 530 are curved along their lengths and when coupled together, they form a channel 311 therebetween that extends through the support 310 (see FIG. 2).

Support portion 500 is an elongate member that has ends 502 and 504. The support portion 500 includes multiple mounting elements at which target areas can be coupled. In FIG. 4, support portion 500 is illustrated as having mounting elements 508 and 510. While only two mounting elements 508 and 510 are illustrated, the support portion may include any number of mounting elements. Mounting elements 508 and 510 are extensions that extend outwardly from the outer surface 516 of the support portion 500. In this embodiment, the mounting elements resemble bottom portions of three branches. The mounting elements 508 and 510 include holes 512 and 514, respectively, through which a connector, such as connector 570, can be inserted.

Support portion 530 is also an elongate member that has ends 532 and 534. Support portion 530 includes several mounting holes 558 located around the support portion 530 through which a connector, such as a screw, can be inserted to couple support portions 500 and 530 together.

Located proximate to end 532 is a wall 536 that forms a receptacle 538. The wall 536 and receptacle 538 collectively form a coupling element that is configured to receive a corresponding coupling element or portion of target area 430 so that target area 430 is coupled to support 310. Support portion 530 includes mounting elements 540 and 542 that have holes 544 and 546, respectively. A connector, such as connector 572, can be inserted through hole 546 as illustrated. When housing portions are aligned together, connector 570 can be inserted through holes 512 and 544. Similarly, connector 572 can be inserted through holes 514 and 546.

When support portions 500 and 530 are coupled together, mounting elements 508 and 540 are disposed proximate to each other and form a region or space therebetween that can be referred to as a mounting area 548. Similarly, mounting elements 510 and 542 are disposed proximate to each other and form another region therebetween that can be referred to as a mounting area 550. In particular, referring to FIG. 4, the mounting area 550 is defined by mounting elements 510 and 542 and by ends 552 and 554 of the side wall of support portion 530. Similarly, the mounting area 548 is defined by mounting elements 508 and 540 and by ends 553 and 555 of the side wall of support portion 530. The function of the mounting areas 548 and 550 is illustrated in FIG. 5 and described below. Support portion 530 includes an opening 560 formed along its lower end or surface.

Referring to FIG. 5, support 310 is illustrated with support portion 500 removed, thereby illustrating some of the internal components of the support 310. As shown, support portion 530 includes mounting elements 540 and 542 as described with respect to FIG. 4. A coupler 440 is mounted proximate to mounting element 542 in mounting area 550. Similarly, a coupler 480 is mounted proximate to mounting element 540 in mounting area 548.

In this embodiment, coupler 440 includes a body 442 with an engaging end 444 having an engaging portion 446 and a coupling end 448 opposite the engaging end 444. The body 442 includes a hole through which connector 572 can be inserted. Once the connector 572 is inserted, the coupler 440 can pivot about the connector 572. Movement of the coupler 440 about the connector 572 can be limited by the ends 552 and 554 of the side wall of the support portion 530 (see FIG. 4). Similarly, coupler 480 includes a body 482 with an engaging end 484 having an engaging portion 486 and a coupling end 488 opposite the engaging end 484. The body 482 includes a hole through which connector 570 can be inserted. Once the connector 570 is inserted, the coupler 480 can pivot about the connector 570. Movement of the coupler 480 about the connector 570 can be limited by the ends 553 and 555 of the side wall of the support portion 500. A biasing mechanism such as a spring can be mounted on the connectors 570 and 572 to bias the couplers 440 and 480 in the desired direction, whether upwardly or downwardly.

Referring to FIG. 5, a target area 350 is illustrated as being coupled to coupler 440. As the support 310, including support portion 530, moves along the direction of arrow "I," the coupler 440 and target area 350 move along the direction of arrow "K" as described below. As the support 310 moves along the direction of arrow "J," the coupler 440 and target area 350 move along the direction of arrow "L."

As illustrated in FIG. 5, the support 310 includes a slide member 600, an elongate member 650, and a locking lever 680. Referring to FIGS. 5 and 6, the slide member 600 includes a body 602 with ends 604 and 606 and a surface 608. The body 602 includes two slots 610 and 612 extending therethrough. Conventional connectors 630 and 632 can be inserted into slots 610 and 612, respectively, and into mounting structures 562 and 564 formed on the inner surface 556 of support portion 530 (see FIG. 4). The connectors 630 and 632 couple the slide member 600 to the support portion 530 for movement relative thereto.

Slide member or elongate member 600 also includes several abutments or projections 614, 616, and 618 spaced apart on the body 602. The slide member 600 may include one or more projections on the other side of the body 602. The projections 614, 616, and 618 are configured to extend outwardly from the body 602 and to engage one of the couplers 440, 460, 470, and 480. As illustrated in FIG. 5, projection 614 is configured to contact the engaging end 444 of coupler 440 as support portion 530 moves along the direction of arrow "I" and the slide member 600 moves along the direction of arrow "J." Similarly, projection 616 is configured to contact the engaging end 484 of coupler 480 as support portion 530 moves along the direction of arrow "I" and the slide member 600 moves along the direction of arrow "J." Projection 618 is configured to engage another coupler (not shown) in a similar manner. The movements of the various components are discussed in greater detail below.

Elongate member 650 includes a body 652 with opposite ends 654 and 656. The body 652 includes an extension 658 that extends outwardly from one side. Proximate to end 656 an engaging portion 660 that includes a pair of plates 662 and 664 that have lower ends 666 and 668. End 656 of the elongate member 650 engages an upper connector 700 that is mounted at the lower end 534 of support portion 530.

The support 310 also includes a lever 680 that is pivotally mounted to an inner surface of support portion 530. Lever 680 includes a body 682 with opposite ends 684 and 686 and a mounting hole 690. A connector 694 can be inserted into the mounting hole 690 to couple the lever 680 to the support portion 530. The body 682 may also include a protrusion 692 that extends from a surface. A biasing mechanism 640, such as a spring, may be provided between the lever 680 and an inner surface of the support portion 530 to bias the lever 680 in a particular direction. The lever 680 is used to lock the slide member 600 in its upper position when the support 310 is moved along the direction of arrow "I."

When the support 310 and support portion 530 is moved along the direction of arrow "I," the lower end 606 of the slide member 600 contacts the upper end 654 of elongate member 650. As the support portion 530 continues to move in that direction, the slide member 600 moves along the direction of arrow "J" relative to the support portion 530. The movement of the slide member 600 in that direction is limited by the length of the slots 610 and 612. As the slide member 600 moves along the direction of arrow "J," projection 614 contacts engaging portion 446 of coupler 440 and causes coupler 440 and target area 350 to pivot about connector 572 along the direction of arrow "K." At the same time, projection 616 contacts engaging portion 486 of coupler 480 and causes coupler 480 to pivot about connector 570 along the direction of arrow "N." Accordingly, the target areas connected to couplers 440 and 480 move from their respective first positions to their respective second positions, as previously described. As previously mentioned, the lever 680 is used to lock and retain the slide member 600 in its upper position. Additional couplers and projections on the slide member can be used to cause movement of additional target areas relative to the support.

During operation of a game, the support 310 rotates or spins about its longitudinal axis. After a certain period of time has elapsed, the support 310 and support portion 530 are moved along the direction of arrow "J." These movements will be described in greater detail below. As the support portion 530 moves along the direction of arrow "J," the elongate member 650 releases the lever 680 which in turn disengages from and releases the slide member 600 from its upper position. Free to move, the slide member 600 moves along the direction of arrow "I" relative to the support portion 530 and the couplers 440 and 480. As a result, the projections 614 and 616 disengage from couplers 440 and 480, respectively.

A spring is mounted on each of the connectors 570 and 572. When coupler 440 disengages from projection 614, coupler 440 and target area 350 pivot about connector 572 along the direction of arrow "L" to their upper positions. The spring mounted on connector 572 causes the coupler 440 to rotate in that particular direction. Similarly, when coupler 480 disengages from projection 616, coupler 480 and its associated target area pivot about connector 570 along the direction of arrow "M" to their upper positions. The spring mounted on connector 570 causes the coupler 480 to rotate in that particular direction.

Referring to FIG. 6, the support portions 500 and 530 are illustrated. In this embodiment, features with similar structures and functionality to features already described have the same reference numbers. A different embodiment of a slide member 600 is illustrated. In this implementation, slide member 600 includes projections 640 and 642 that are disposed on opposite side of the slide member 600. As slide member moves along the direction of arrow "O," the projections 640 and 642 contact the engaging portions of different couplers to move the couplers and the target areas as previously described.

Also illustrated in FIG. 6 is another coupler 460 which is mounted on connector 462 for pivoting or rotating movement about the connector 462. A spring 495 is mounted on the connector 462 and is configured to bias the coupler 460 in a desired direction. An opening 493 is formed in support portion 500. Support portion 500 includes a wall 506 defining a receptacle 507. Collectively, the wall 506 and the receptacle 507 define a coupling element.

Figure 7:
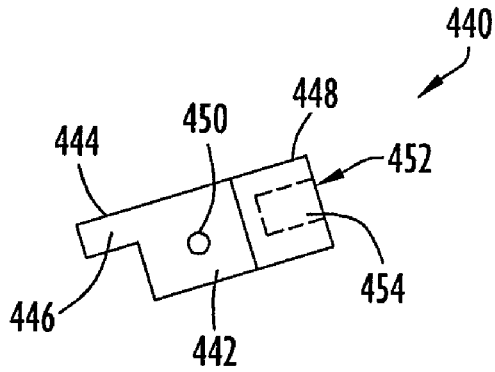
FIG. 7 is a side view of an embodiment of a coupler according to the present invention.

Referring to FIG. 7, an embodiment of a coupler according to the invention is illustrated. In this embodiment, coupler 440 includes a body 442, an engaging end 444 with an engaging portion 446 and a mounting end 448. The body 442 includes a hole 450 and proximate to end 448 there is an opening 452 in communication with an internal cavity 454. The cavity 454 is configured to receive a portion of a target area as illustrated in FIG. 5.

Figure 8:
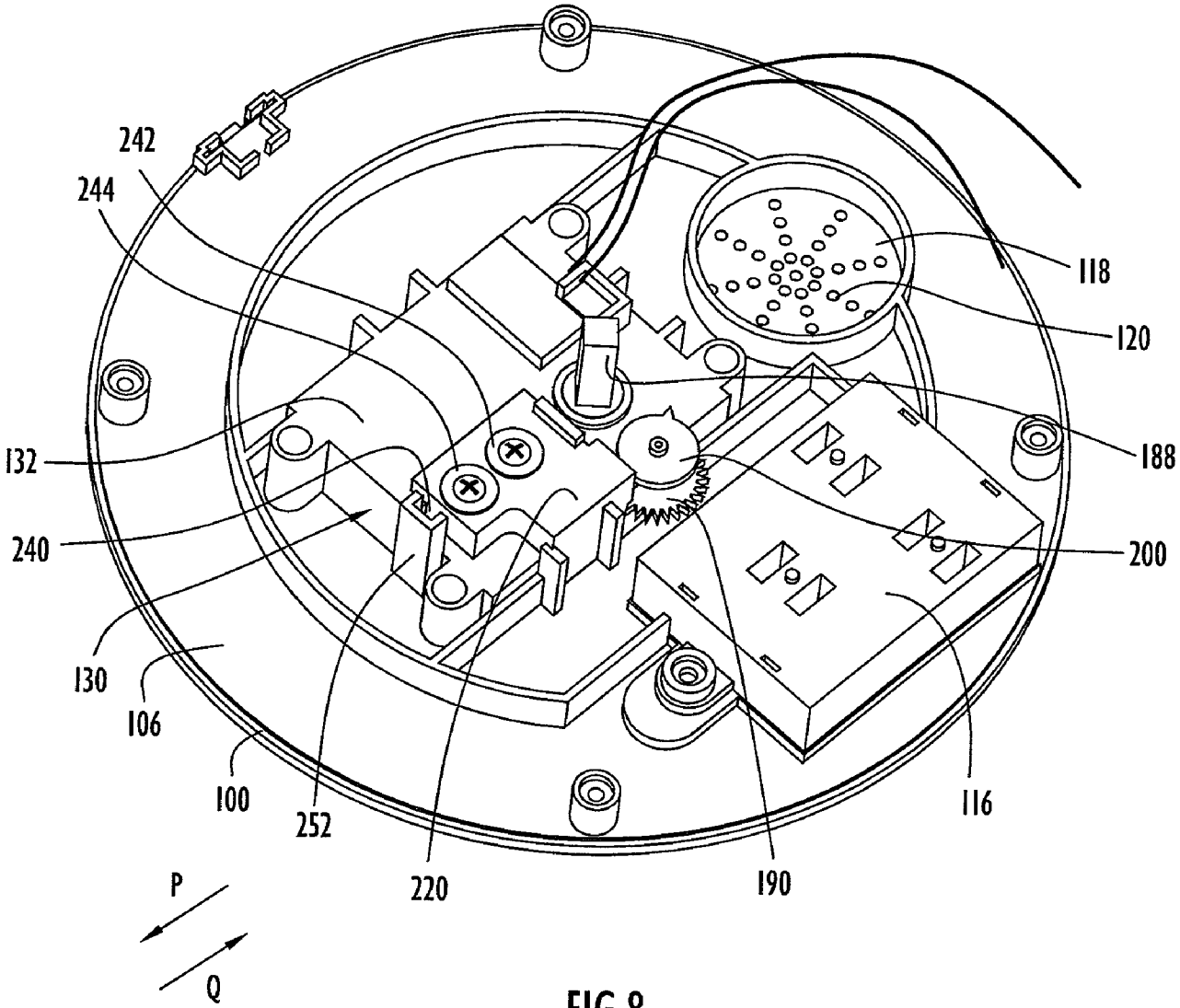
FIGS. 8 and 9 are a perspective view and a top view, respectively, of some of the components of the drive mechanism and the base of the game illustrated in FIG. 1.
Figure 9:
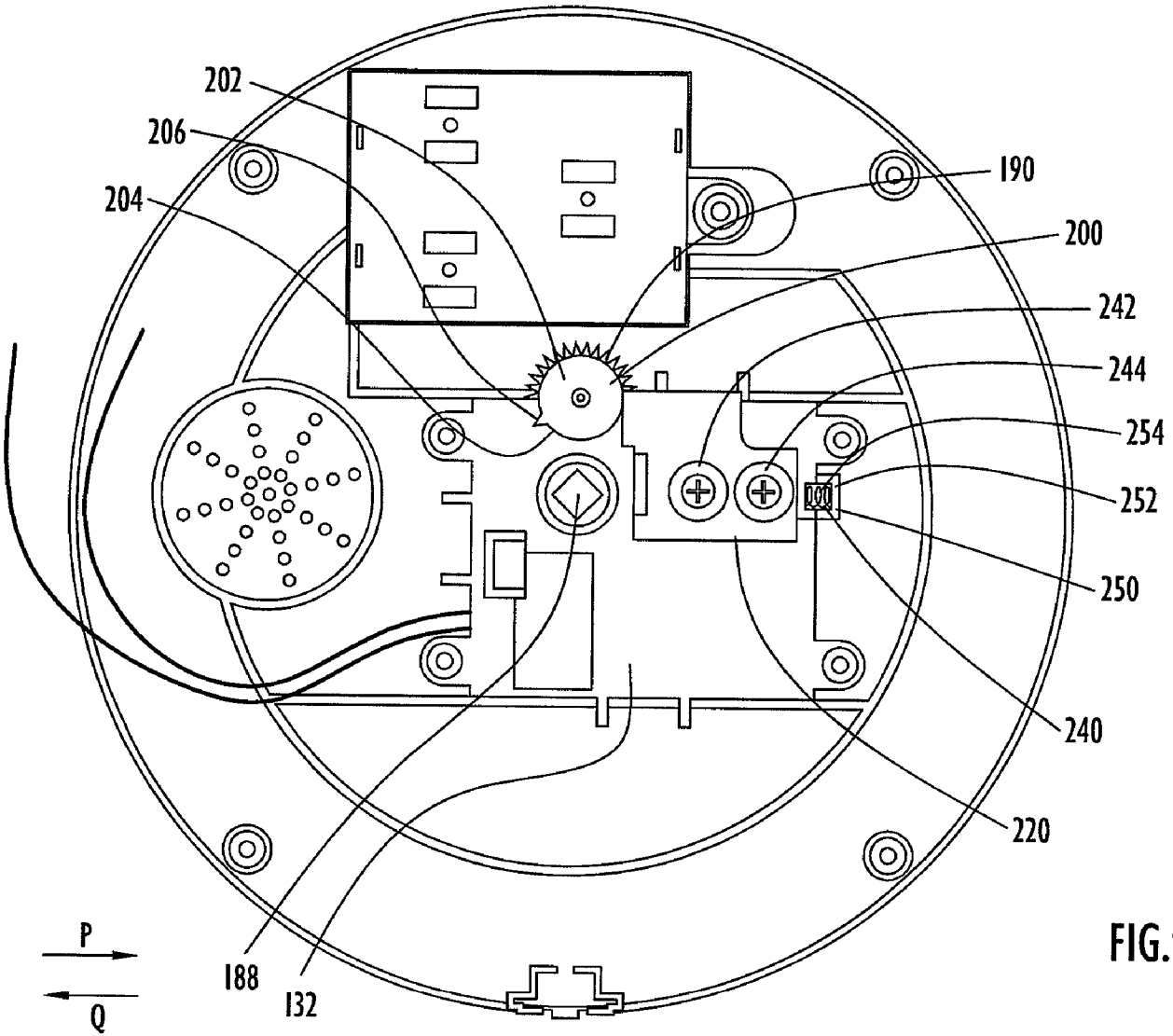
Figure 10:
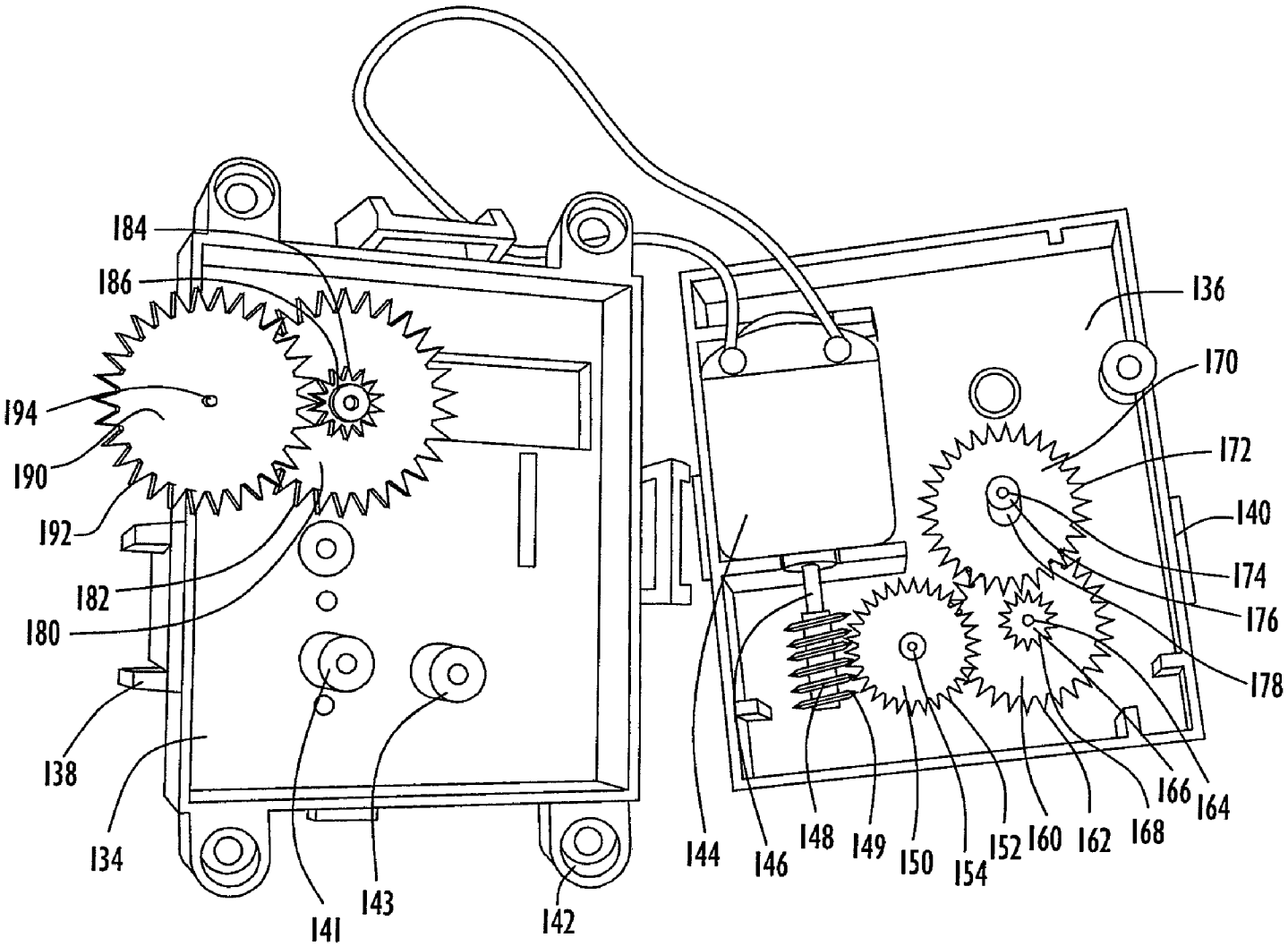
FIG. 10 is a top view of some of the components of the drive mechanism of the game illustrated in FIG. 1.

Referring to FIGS. 8-10, some of the components of an embodiment of a drive mechanism of the game are illustrated. Referring to FIGS. 8 and 9, the lower portion 106 of the base 100 is illustrated with the upper portion 104 of the base 100 removed. The base 100 includes a compartment 116 that can receive a power source such as batteries. The base 100 also includes a receptacle 118 for an audible output device, such as a speaker, with several holes 120 formed through the lower surface of the base 100.

The game 10 includes a drive mechanism 130 that imparts movement to the target assembly 300 so that components of the target assembly 300 move relative to the base 100. The drive mechanism 130 includes a drive housing 132. Referring to FIG. 10, the internal components of the drive mechanism 130 are illustrated. As shown, the drive housing 132 includes two portions 134 and 136 that can be coupled together with several couplers 138 and 140 located on each portion. Housing portion 134 includes several mounting structures 142 to facilitate the mounting of the drive housing 132 on the base 100.

The drive mechanism 130 includes a motor 144 that has a drive shaft 146. Mounted on the drive shaft 146 is a worm gear 148 that has a thread 149 along its length. Engaged with the worm gear 148 is a gear 150 with teeth 152 that engage the thread 149. Gear 150 is rotatably mounted on axle 154 which is supported at one end in a support 141 formed in housing portion 134. Gear 150 includes a pinion (not shown) that rotates with the gear 150. Proximate to gear 150 is a gear 160 with teeth 162 that engage the teeth of the pinion of gear 150. Gear 160 is rotatably mounted on axle 164 and includes a pinion 166 with teeth 168. Axle 164 is supported at one end in support 143 formed in housing portion 134. Proximate to gear 160 is a gear 170 with teeth 172 that engage the teeth 168 of pinion 166. Gear 170 is rotatably mounted on axle 174 and includes a pinion 176 with teeth 178.

Figure 15:
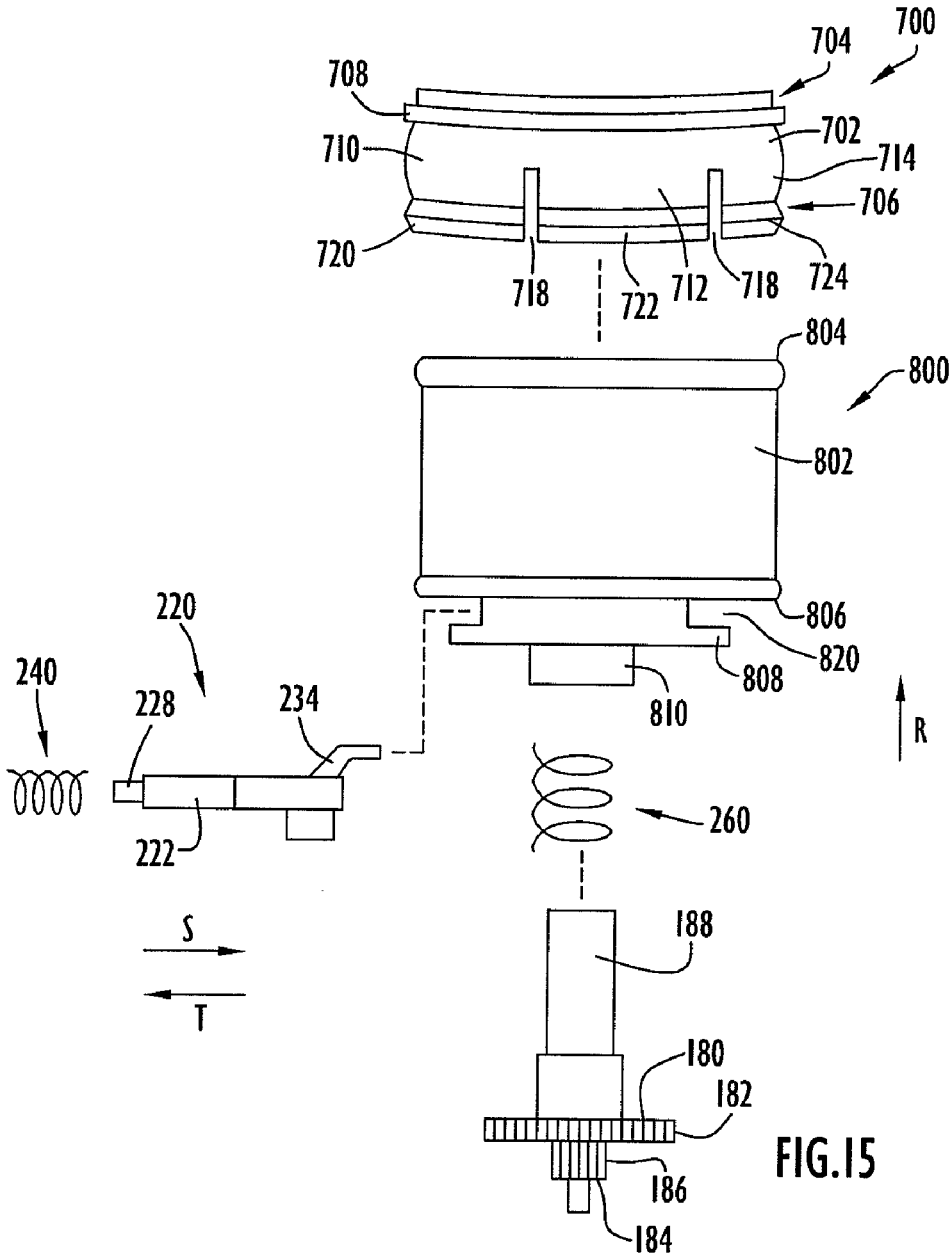
FIG. 15 is an exploded side view of some of the components of the game illustrated in FIG. 1.

Coupled to housing portion 134 is gear 180 that has teeth 182 that engage teeth 178 of pinion 176. Gear 180 includes a pinion 184 with teeth 186. Also coupled to housing portion 134 is gear 190 that has teeth 192 and that is mounted on axle 194. The teeth 192 of gear 190 engage the teeth 186 of pinion 184. As illustrated in FIGS. 8, 9, and 15, gear 180 includes an output shaft 188 on an opposite side from pinion 184. The output shaft extends out of the drive housing 132.

Figure 13:
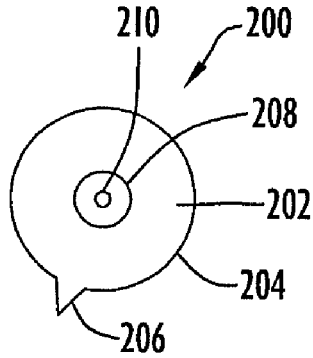
FIGS. 13 and 14 are a top view and a side view, respectively, of an embodiment of a disk according to the present invention.
Figure 14:
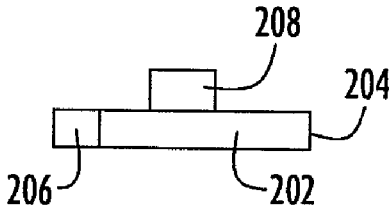

As illustrated in FIG. 8, the drive mechanism 130 includes a disk 200 disposed proximate to the drive housing 132. The disk 200 is mounted on axle 194 and rotates with gear 190. Referring to FIGS. 13 and 14, an embodiment of a disk is illustrated. Disk 200 includes a body 202 with a perimeter 204 along which a protrusion or tag 206 is located. The body 202 includes a centrally located shaft 208 with an opening 210 therethrough that is configured to receive axle 194.

When power is supplied to the motor 144, the drive shaft 146 rotates and motion is imparted to gears 150, 160, 170, 180, and 190. At the same time, the output shaft 188 rotates and the disk 200 rotates. When the power is turned off or otherwise disconnected, the drive shaft 146 and the gears stop rotating.

Referring to FIGS. 8 and 9, the drive mechanism 130 includes a latch 220 that is movably mounted on the drive housing 132. The latch 220 is mounted for lateral movement along the directions of arrows "P" and "Q." A biasing mechanism 240, such as a spring, applies a force on latch 220 to move along the direction of arrow "Q." The disk 200 is mounted proximate to the latch 220 so that only the protrusion 206 contacts the latch 220 as the disk 200 rotates. The protrusion 206 contacts the latch 220 with sufficient force to cause the latch 220 to move along the direction of arrow "P." The period of rotation of the disk 200 can vary depending on the speed at which the motor is driven. In one embodiment, the disk 200 makes one revolution in approximately 45 seconds. In that example, the protrusion 206 engages a portion of the latch 220 approximately 45 seconds after the disk 200 starts to rotate. The base 100 includes a support 250 having a wall 252 defining a receptacle 254 in which spring 240 is disposed.

Figure 11:
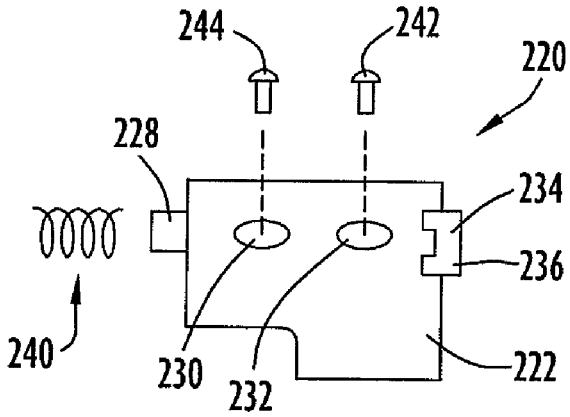
FIGS. 11 and 12 are a top view and a side view, respectively, of an embodiment of a latch according to the present invention.
Figure 12:
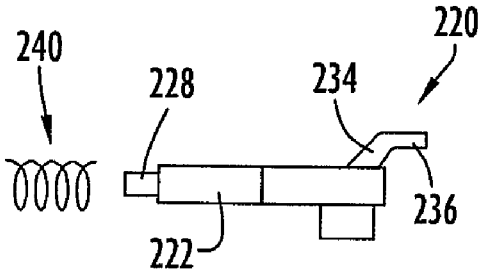

Referring to FIGS. 11 and 12, an embodiment of a latch according to the invention is illustrated. In this embodiment, latch 220 includes a body 222 with a post 228 extending therefrom that is configured to receive spring 240. The body 222 also includes slots 230 and 232 through which connectors 242 and 244, such as screws, can be inserted. The range of motion of the latch 220 is determined by the length of the slots 230 and 232. The latch 220 also includes an extension 234 with a lip 236. The extension 234 extends outwardly and upwardly from the body 222.

Referring to FIG. 15, some of the components of the game are illustrated. In this embodiment, the game includes an upper coupler 700 that is coupleable to the lower end of the support 310. A lower coupler 800 is configured to receive the upper coupler 700. The lower coupler 800 is mounted in the base 100 and in particular, in communication with opening 112 in the projection 108 of the base 100. The lower coupler 800 is mounted on the output shaft 188 of gear 180 so that as gear 180 rotates, lower coupler 800 rotates and the upper coupler 700 and support 310 also rotate. A spring 260 is disposed between gear 180 and the lower coupler 800 to bias the lower coupler 800 along the direction of arrow "R."

Figure 16:
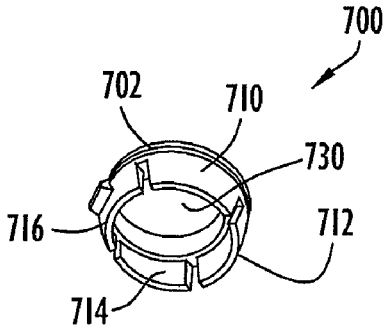
FIG. 16 is a bottom perspective view of an embodiment of an upper coupler according to the present invention.

In this embodiment, the upper coupler 700 has a body 702 with an upper end 704 and a lower end 706. A ridge 708 is formed on the body 702 proximate to upper end 704 and is configured to be captured between the support portions 500 and 530. The body 702 includes several plate-like portions 710, 712, 714, and 716 that are defined by slits 718. The plate-like portions 710, 712, 714, and 716 include tabs 720, 722, 724, and 726, respectively, that are used to connect the upper coupler 700 to the lower coupler 800. The body is formed with a substantially circular configuration and an opening 730 that extends through the body 702 (see FIG. 16).

Figure 17:
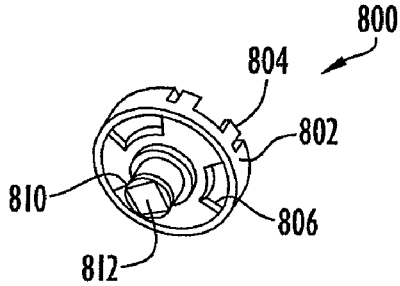
FIG. 17 is a bottom perspective view of an embodiment of a lower coupler according to the present invention.

In this embodiment, the lower coupler 800 has a body 802 with an upper end 804 and a lower end 806. The body 802 includes an internal cavity that is configured to receive the plate-like portions 710, 712, 714, and 716 and the tabs 720, 722, 724, and 726 of the upper coupler 700. The upper coupler 700 can be snapped into the lower coupler 800. Proximate to its lower end 806, the lower coupler 800 includes a ridge or rim 808 that defines an annular groove or opening 820. An extension 810 extends from end 806 of the lower coupler 800. As illustrated in FIG. 17, the extension 810 includes an opening or channel 812 that is configured to receive the output shaft 188 of gear 180. The cross-section of opening 812 is configured to mate with the cross-section of shaft 188 so that the lower coupler 800 rotates with gear 180.

Referring to FIG. 15, an exemplary interaction between the latch 220 and the lower coupler 800 is illustrated. When the target assembly 300 is pressed downwardly, the lower coupler 800 is moved downwardly sufficiently so that extension 234 engages the annular groove 820. When lower coupler 800 is in this position, a switch is closed and power is supplied to motor 134, thereby activating the drive mechanism 130.

As previously discussed, spring 240 biases the latch 220 along the direction of arrow "S." When the latch 220 extends in that direction, extension 234 engages groove 820 of the lower coupler 800 and prevents lower coupler 800 from moving along the direction of arrow "R." When the drive mechanism 130 operates, gear 180 rotates and causes lower coupler 800 and upper coupler 700 to rotate as well. When the disk 200 rotates so its protrusion 206 engages a portion of the latch 220, the latch 220 moves along the direction of arrow "T" and extension 234 disengages from groove 820. At this point, the spring 260 biases the lower coupler 800 upwardly and the lower coupler 800 moves along the direction of arrow "R." The extent of movement of the lower coupler 800 is limited by the space within the base 100 in which the lower coupler 800 is located. At the same time, the switch is disengaged and the motor is turned off. As a result, the upper coupler 700 and the lower coupler 800 stop rotating. As the couplers 700 and 800 move upwardly along the direction of arrow "R," the support 310 and the remainder of the target assembly 300 move along a direction away from the base 100 as previously described.

Figure 18:
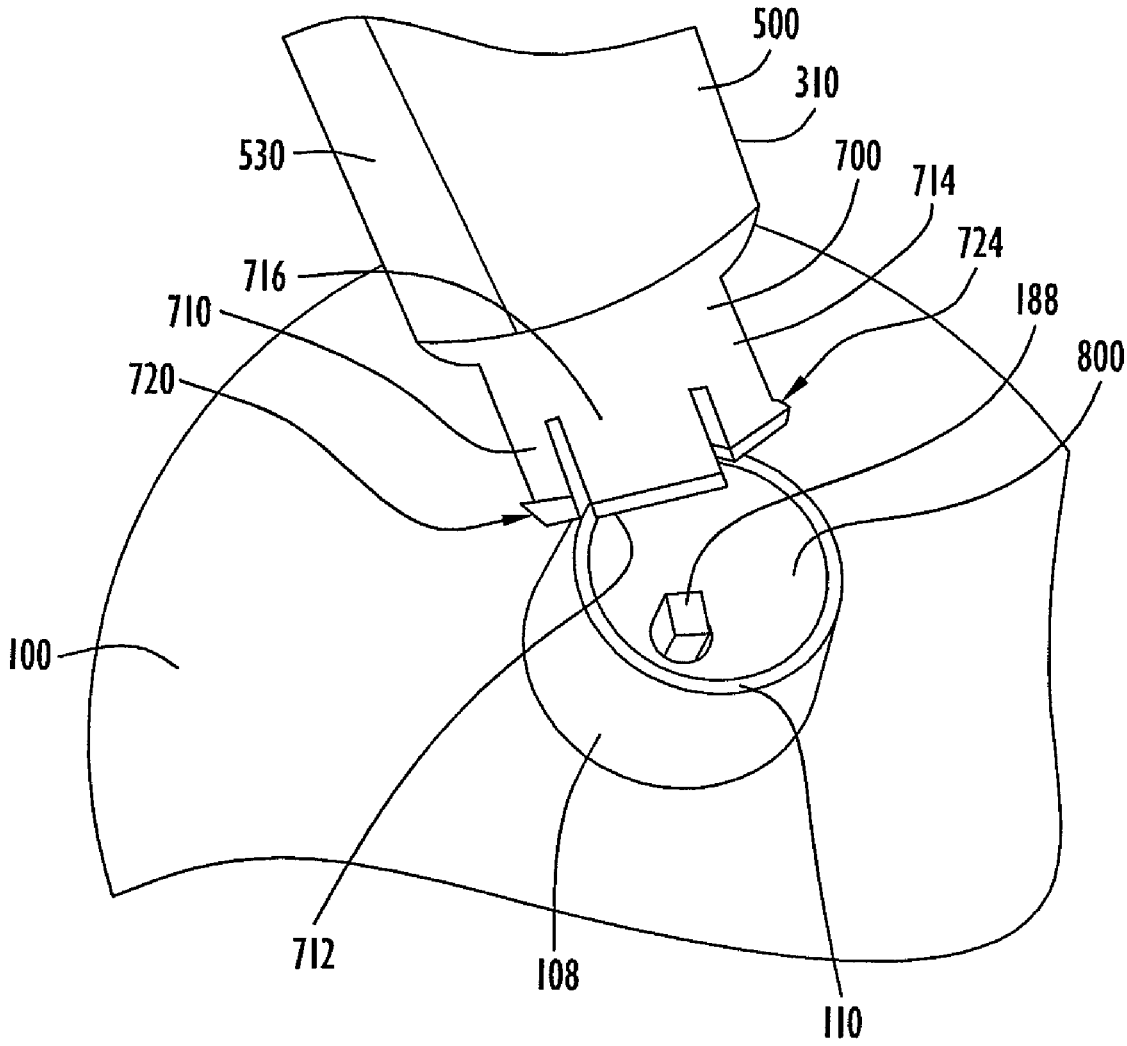
FIG. 18 is a partial perspective view of some of the components of the game illustrated in FIG. 1.

Referring to FIG. 18, the connection of the upper coupler 700 to the lower coupler 800 located within the base 100 is illustrated. The plate-like structures and tabs of the upper coupler 700 engage the lower coupler 800 that is located in the base 100. The output shaft 188 is illustrated as extending into the interior of the lower coupler 800.

Figure 20:
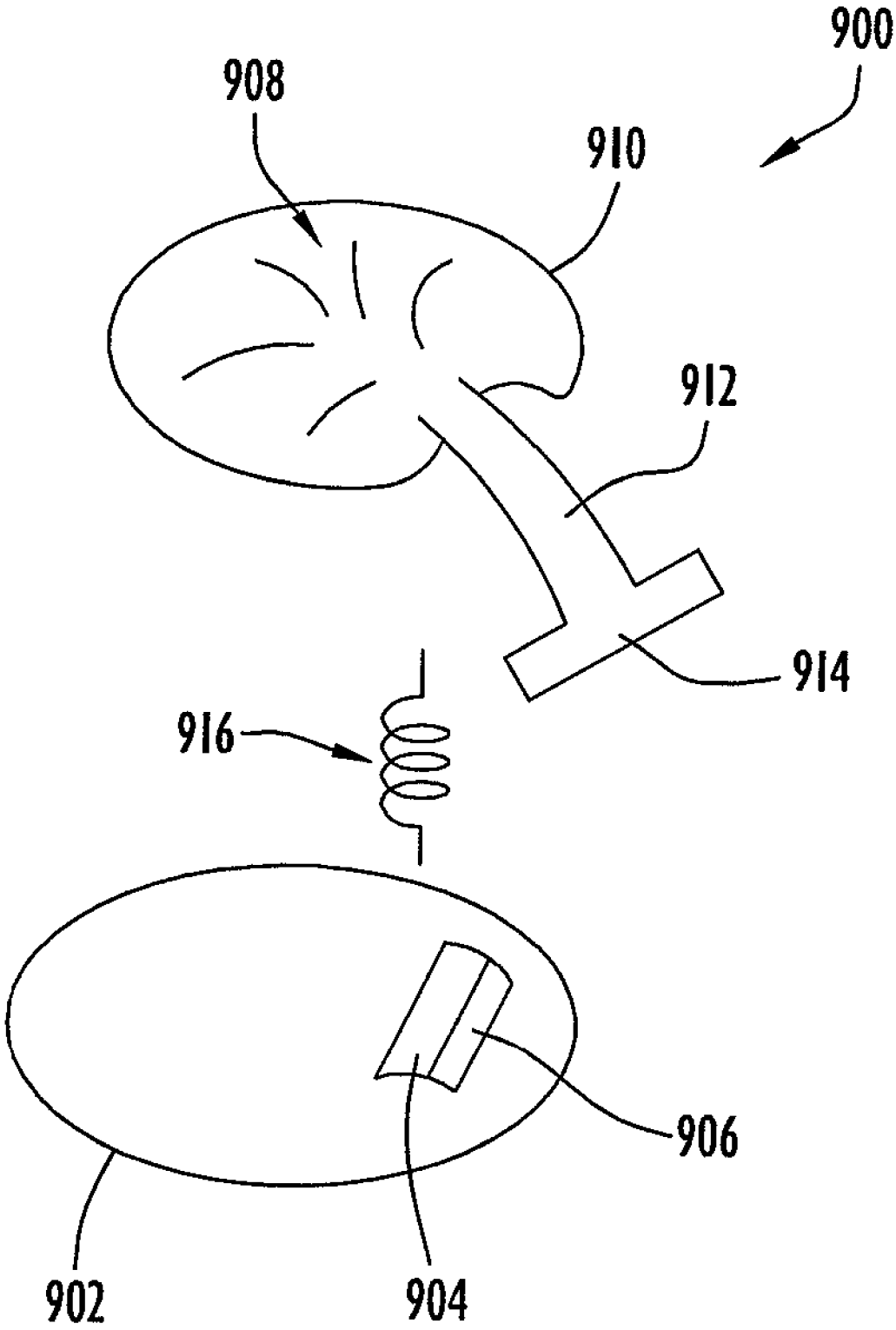
FIG. 20 is an exploded perspective view of an embodiment of a launching mechanism according to the present invention.

Referring to FIG. 20, an exemplary embodiment of a launcher or launching mechanism 900 is illustrated. In this embodiment, the launching mechanism 900 includes a base 902 with an opening 904 and a stop 906 located proximate to the opening 904. A launching portion 908 with a body 910 and a support 912 is coupled to the base 902 via an engaging end 914 that is inserted into the opening 904. A biasing member 916, such as a spring, is disposed between the base 902 and the launching portion 908 to bias the launching portion 908 upwardly. In an alternative embodiment, the launching mechanism can have any type of configuration provided that it can be actuated by a user to launch an object.

Additional embodiments of components of games according to the present invention are described below. In the different embodiments, various game components and features can be used and combined with components and features of other embodiments.

Now an exemplary method of playing a game using the game 10 described above is briefly discussed. In this implementation, the launchers are formed in the configuration of a lily pad and the objects are formed in the configuration of a frog. When the game is turned on and at various points during game play, audible output, such as frog sounds, is generated by the electronic components of the device. In one example, the object of the game is to be the player who gets the most frogs in the target, which in one case resembles a tree, after several rounds of play. The goal is to launch as many objects onto the target before the target pops up because some of the objects will fall off of the target.

One of the players presses on the top of the tree or target assembly 300 and pushes downwardly. That motion closes the switch and activates the drive mechanism 130, thereby causing the target assembly 300 to rotate and in some instances, audible outputs to be generated as well. As the target assembly 300 moves downwardly, the tree branches or target areas also move downwardly. In an alternative embodiment, a suction cup and spring assembly can be used to control the length of play in lieu of the drive mechanism with the upper and lower couplers and latch as discussed above. After a certain period of time, the target assembly pops up and the round is over. An object can be retained on a target or target area in a variety of ways. Some examples include: the object can rest on the target area, a portion of the object can extend into one or more openings of a target area, and a portion of the object can hook or grab onto a portion of a target area.

Figure 21:
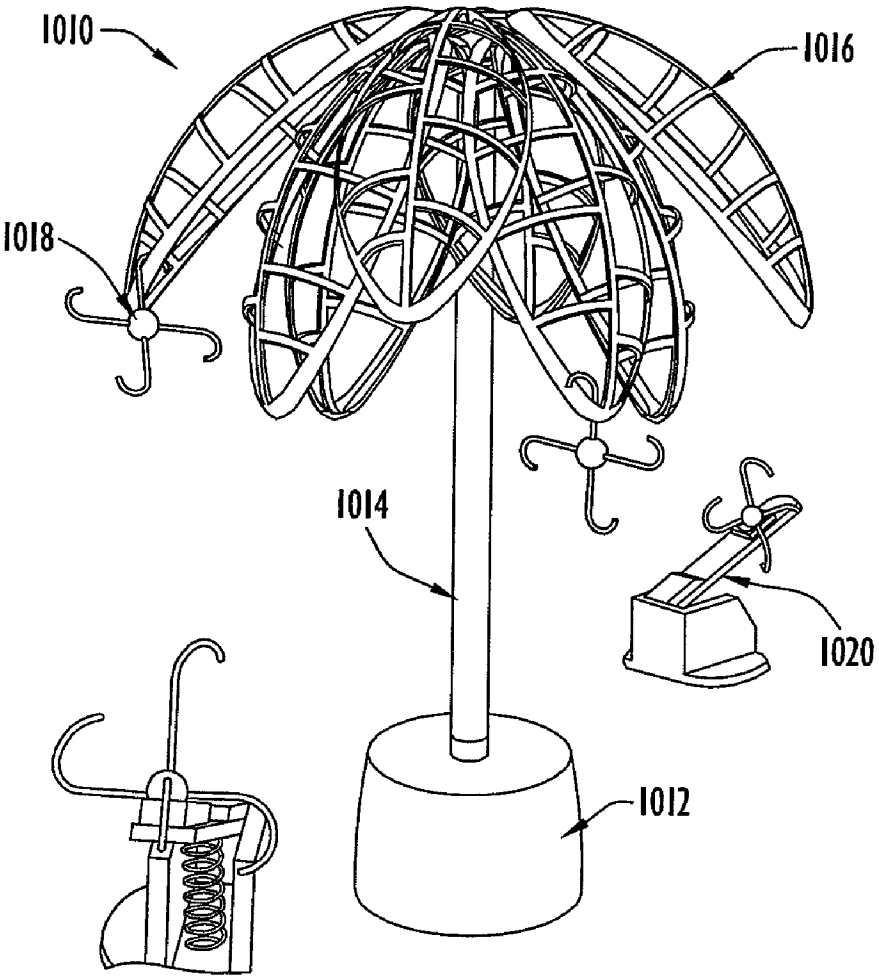
FIG. 21 is a perspective view of an embodiment of a target in the form of a palm tree, showing projectile objects in the form of monkeys having long, hooked arms hanging from target areas which are shown as palm tree leaves.

FIG. 21 shows a target 1010 in the form of a palm tree-like structure with a base 1012, a shaft 1014, and a plurality of target areas 1016 in the general shape of palm tree leaves. A plurality of projectile objects 1018, preferably in the form of monkeys have long, hooked arms extending from a body, are shot at or hung on the palm tree leaves. The arms and/or tails of the monkeys may include small cuffs at the ends. A launcher 1020 may be used to shoot the monkeys at the palm tree leaves, or the monkeys may simply be thrown at the leaves.

Base 1012 is shown at the bottom of target 1010. Base 1012 may serve as a support structure for the remaining elements of the target 1010 and may be manufactured using plastic and may be generally cylindrical in shape.

Shaft 1014 is shown as an elongate cylinder extending vertically from base 1012. Shaft 1014 provides both the necessary support and height for target areas 1016 and may be formed of plastic or other material rigid enough to support the remaining elements. Further, shaft 1014 may be formed in the shape of, or otherwise resemble a tree trunk when, as in the embodiment shown in FIG. 21, target 1010 is implemented as a tree-like structure.

Target areas 1016 are disposed at the top of shaft 1014. Target areas 1016 define a plurality of apertures which provide an area for a user to shoot, toss, fling, launch or otherwise project objects which may be caught or snagged in the apertures. In the embodiment of FIG. 21, target areas 1016 are formed of plastic and are shaped like palm leaves.

Figure 22:
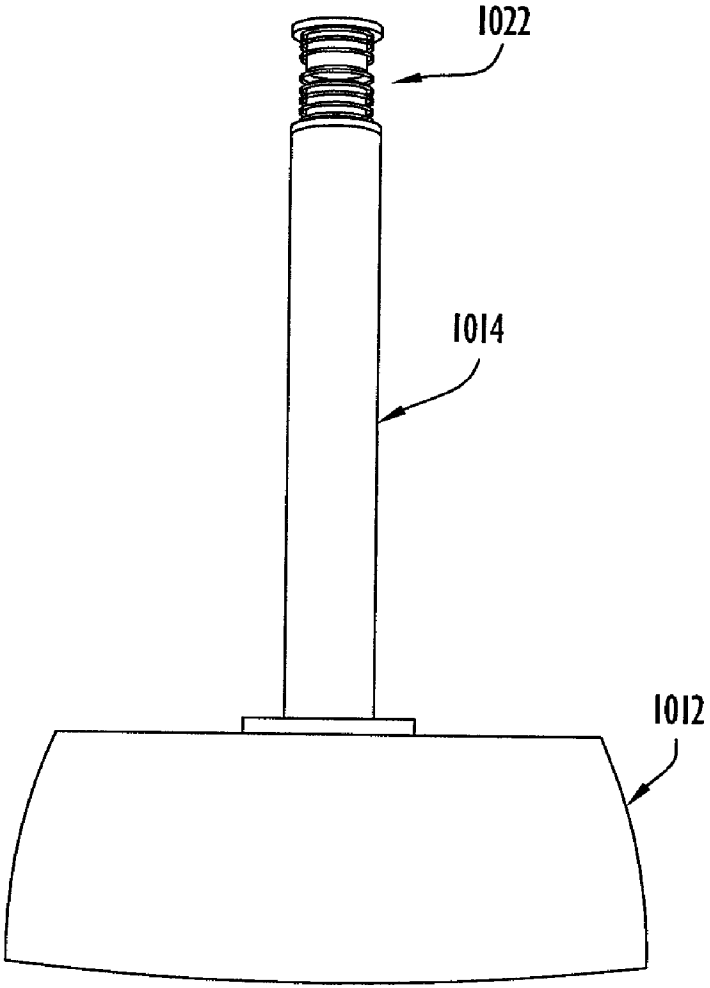
FIG. 22 is a perspective view of the base and shaft portions of the palm tree-like target shown in FIG. 21.

Turning to FIG. 22, base 1012 and shaft 1014 of target 1010 shown in FIG. 21 are shown without target areas 1016 attached. In this embodiment, a spring 1022 is disposed at the top of shaft 1014. When target areas 1016 are attached to shaft 1014, spring 1022 provides a mechanism which allows target areas 1016 to rock or bounce when contact is made with them.

Figure 23:
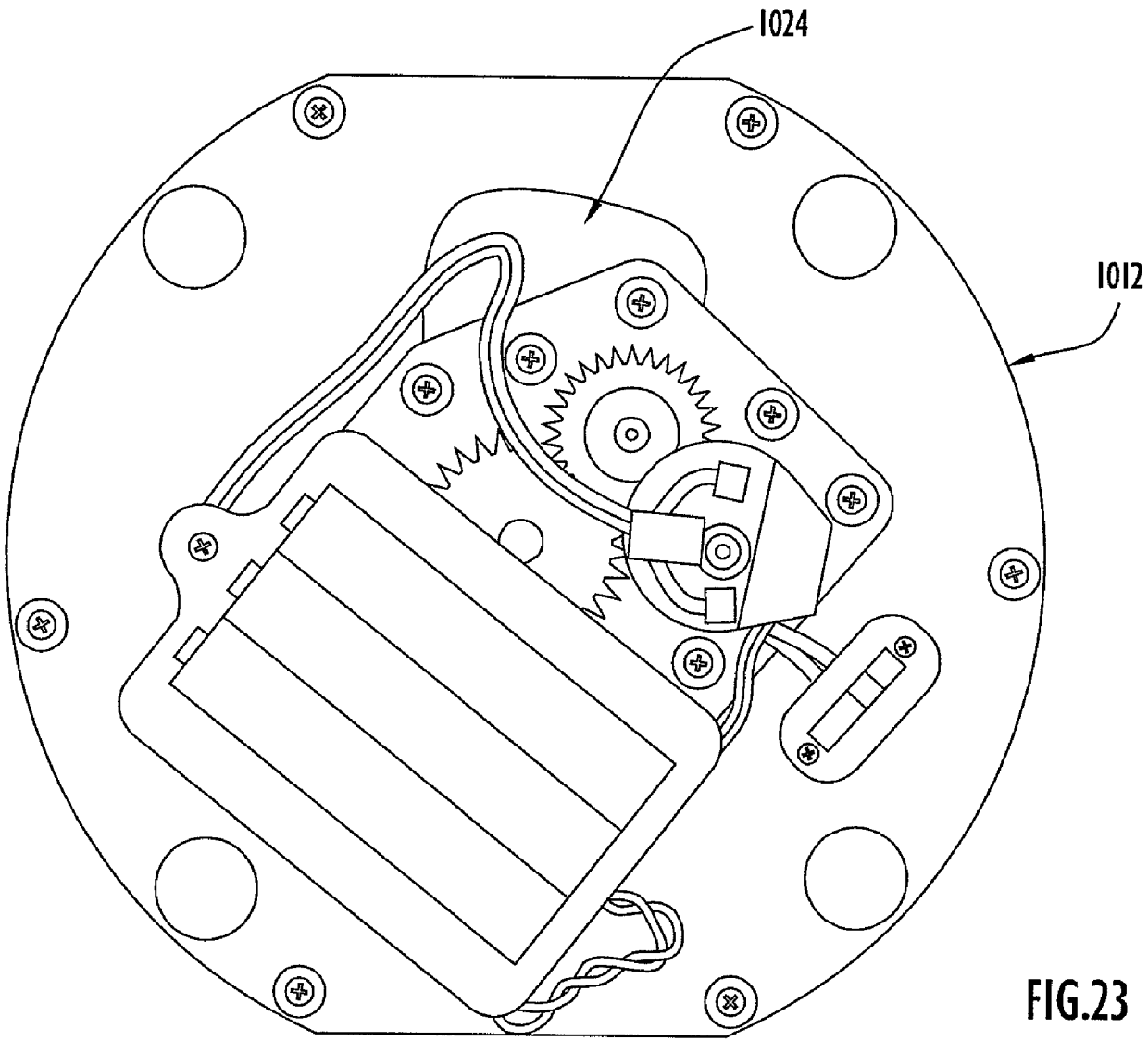
FIG. 23 is a bottom view of a base of the palm tree-like target shown in FIGS. 21-22, showing electrical and mechanical components including batteries, and electric motor, a gear train, and an eccentric weight housed within the base of the target.

FIG. 23 shows a bottom view of base 1012. As shown, electrical and mechanical structures housed in base include a plurality of batteries, an electric motor, a gear train, and an eccentric weight 1024. Turning on the motor spins eccentric weight 1024, causing base 1012 to vibrate or shake. As a result, the remaining elements of the target 1010 are also placed in motion. The motion imparted on target 1010 may remain constant or may occur at timed or random intervals, driven by a mechanical or electronic timer selectively interconnecting the batteries to the electric motor.

A speaker may also be housed within base 1012, connected to an electronic audio device containing one or more preselected noises, songs, or tunes. The electronic audio device may be always on, intermittently on in tandem with or opposite the vibrating motor, or on only when triggered by certain events or devices, such as motion sensors or switches.

Figure 25:
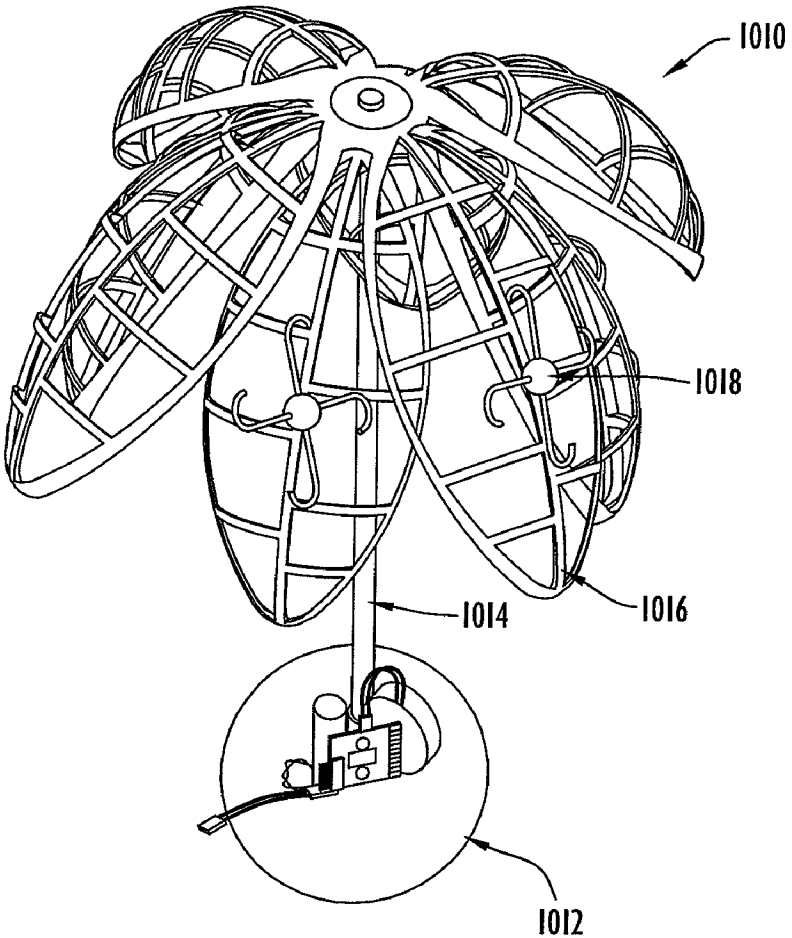
FIG. 25 is an in-the-air perspective view of the palm tree-like target shown in FIG. 24.
Figure 24:
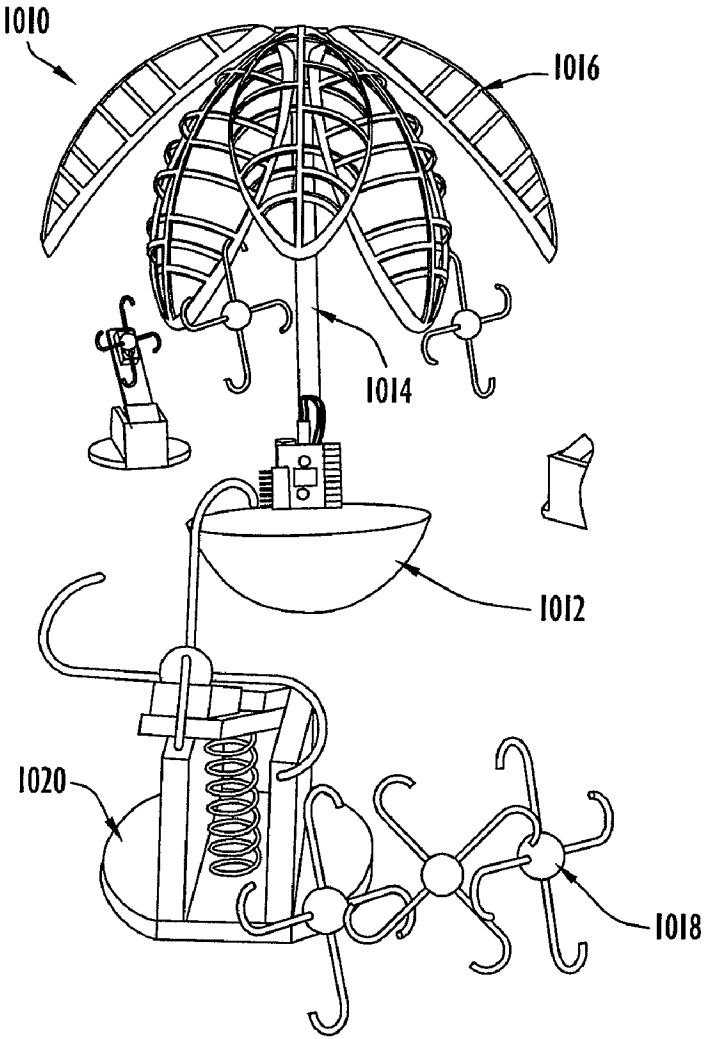
FIG. 24 is a top perspective view of an alternative embodiment of a target formed like a palm tree, showing projectile objects in the form of monkeys hanging from palm tree leaf target areas and resting on launcher.
Figure 26:
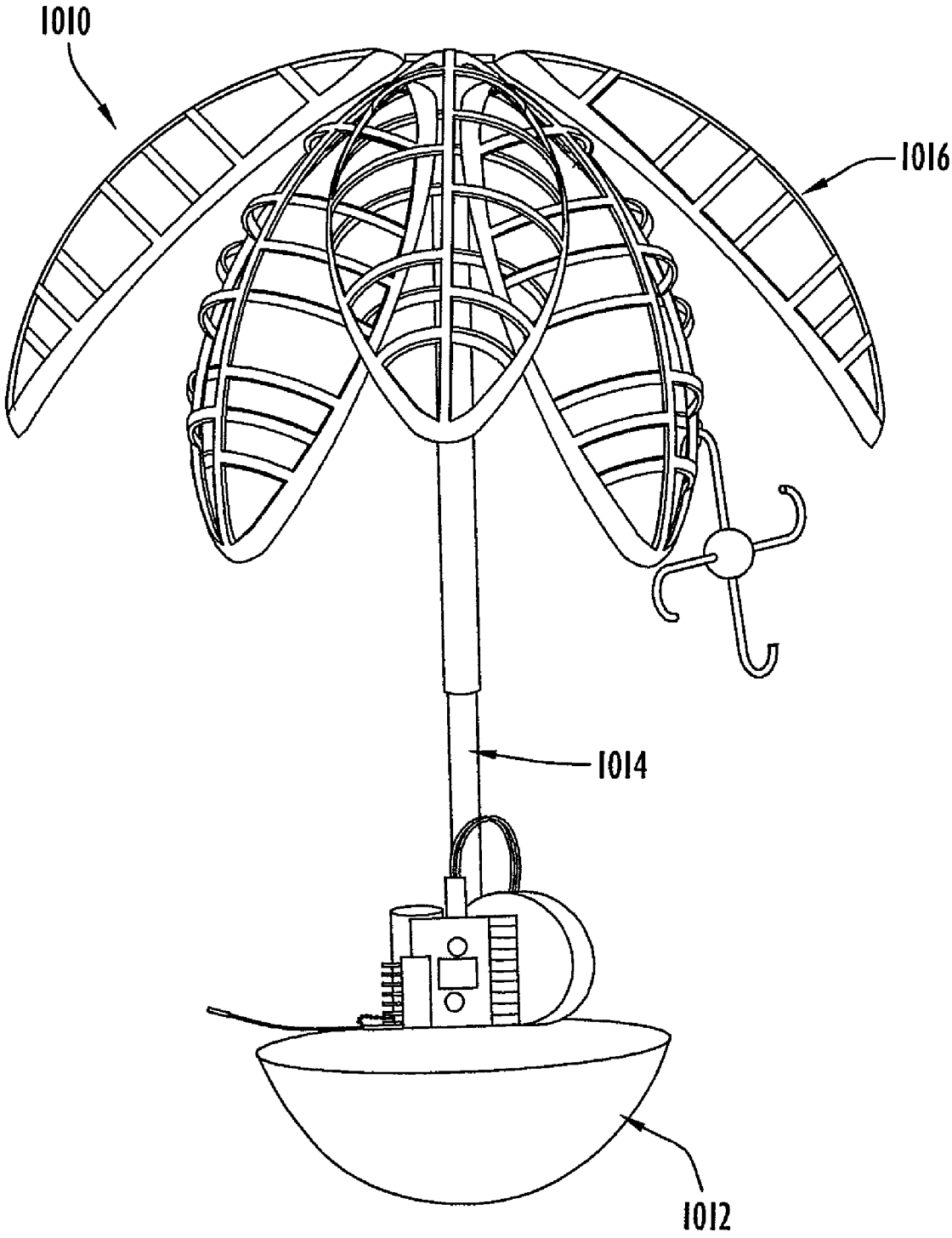
FIG. 26 is a perspective view of the palm tree-like target shown in FIGS. 24-25, showing the apparatus being rolled to a side by a user to start the target rocking.

Referring now to FIGS. 24-26, another embodiment of a target 1010 having a base 1012, a shaft 1014, and target areas 1016 is shown. In this embodiment, base 1012 is shaped as an inverted hemisphere, and a weight, not shown, is fixed near the bottom pole of the hemisphere causing it to be inherently stable. The weight in the base also increases the moment of inertia of the base, causing the target 1010 to remain in motion for longer periods of time when a user spins, rocks, sways, or otherwise forces the target 1010 into motion. Additionally, whenever target 1010 is struck by launched objects, the structure may cause it to sway or otherwise move due to the force of the contact.

Although in the embodiment shown in FIGS. 24-26 is hemispherical, the base 1012 may still serve as housing for electrical or mechanical components as shown in FIG. 23 above. Similar to the embodiments discussed above, electrical and mechanical components may provide for vibrating, spinning, or shaking similar to the embodiment discussed above.

Figure 28:
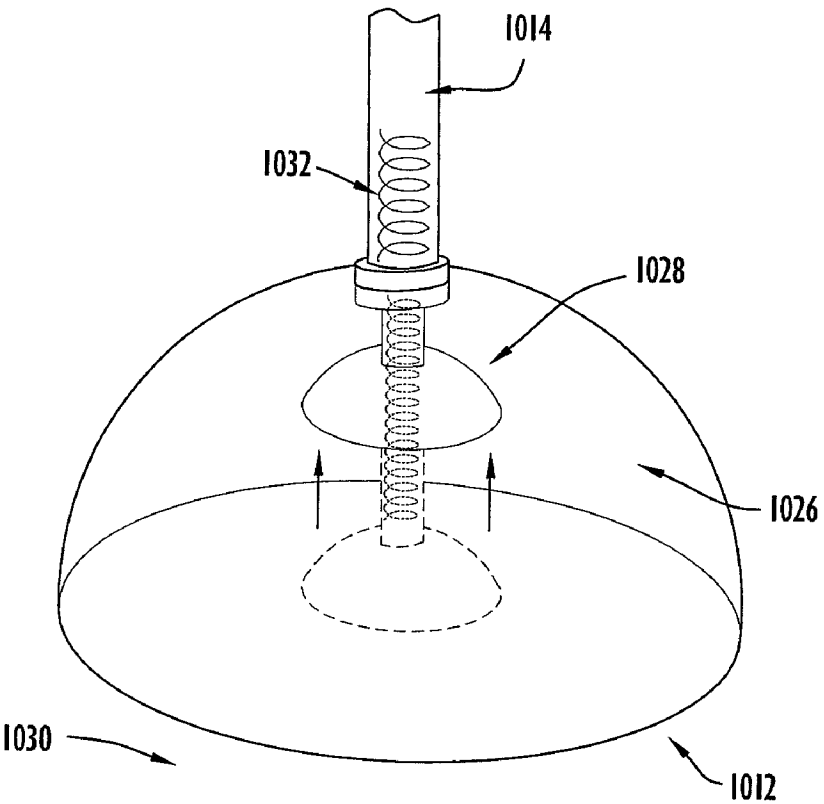
FIG. 28 shows a close-up view of the suction cup timing mechanism seen in FIG. 27.
Figure 27:
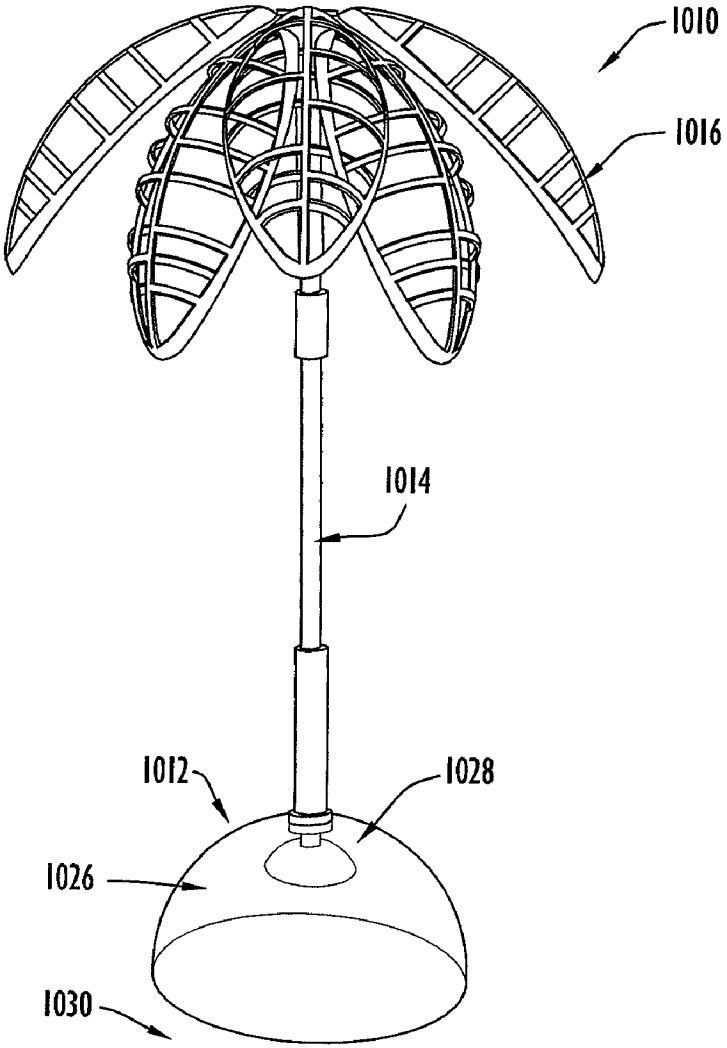
FIG. 27 is a view of another embodiment, featuring a palm-tree like target with a base which includes a suction cup timing mechanism.

Referring now to FIGS. 27-28, another embodiment of a target 1010 having a base 1012 with a hollow interior 1026, a shaft 1014, a suction device 1028, a biasing mechanism 1032 contained wholly or partially within the shaft 1014, an underlying surface 1030, and target areas 1016 is shown. In this embodiment, base 1012 is shaped as a hemisphere with a hollow interior 1026, and a suction device 1028 is fixed along the center axis of the hemisphere and contained within the hollow interior 1026. The suction device 1028 is capable of being affixed to the underlying surface 1030, and will remain affixed to the underlying surface 1030 for a amount of time related to various parameters, including (1) the strength and shape of the suction device 1028, (2) the strength of a spring or biasing mechanism 1032 contained wholly or partially in the shaft 1014, and (3) the texture of the underlying surface 1030 to which the suction device 1028 is attached.

In one possible embodiment, the shaft 1014 could be provided with a biasing mechanism 1032 as shown by the dotted line structure in FIG. 28. The biasing mechanism 1032 could be a spring attached at one end to the suction device 1028 and at the other end to a structure higher in the shaft. When the suction device 1028 is disengaged from the underlying surface 1030, the biasing mechanism exerts relatively little force. However, when the suction device 1028 is affixed to the underlying surface 1030, the biasing mechanism 1032 stretches. The stretching of the biasing mechanism builds potential energy and therefore provides a relatively strong force, in the direction of the force arrows in FIG. 28, in opposition to the suction device's 1028 hold on the underlying surface 1030. Upon release of the suction device 1028 from the underlying surface 1030, the stored potential energy in the biasing mechanism changes to kinetic energy, and the biasing mechanism abruptly moves the suction device 1028 up away from the underlying surface in the direction of the force arrows. When the suction device 1028 reaches its apex, the remaining kinetic energy is transferred into the shaft 1014, thereby abruptly moving the target 1010 and target areas 1016. Such abrupt movement could potentially dislodge some of the projectile objects 1018 from the target areas 1016.

Figure 30:
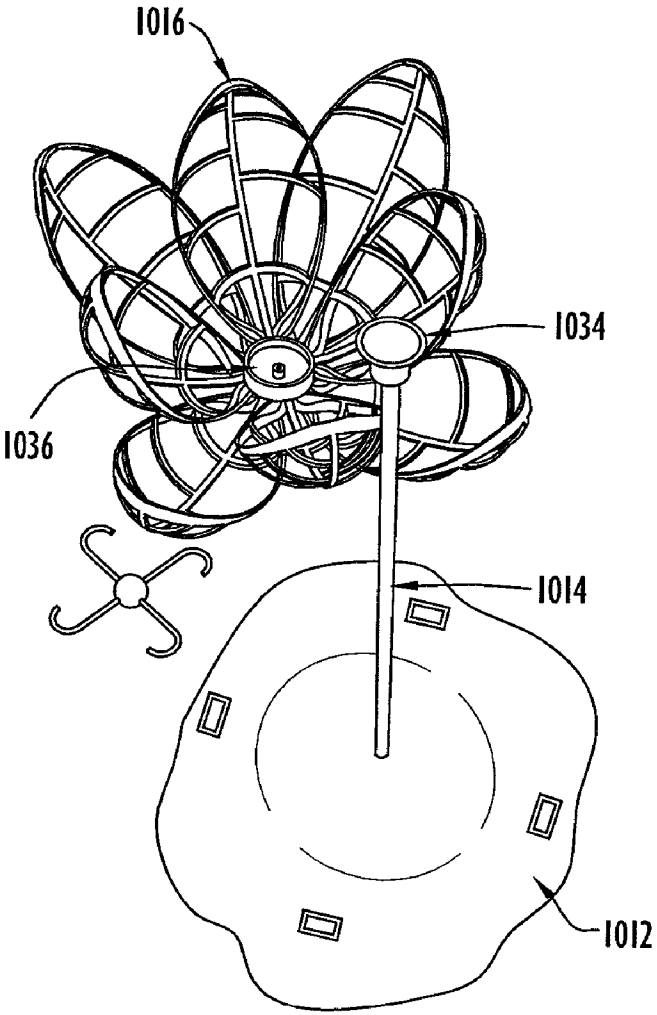
FIG. 30 is a top perspective view of the target shown in FIG. 29, showing the palm tree leaf-like target areas removed from the base and shaft portions of the target.
Figure 29:
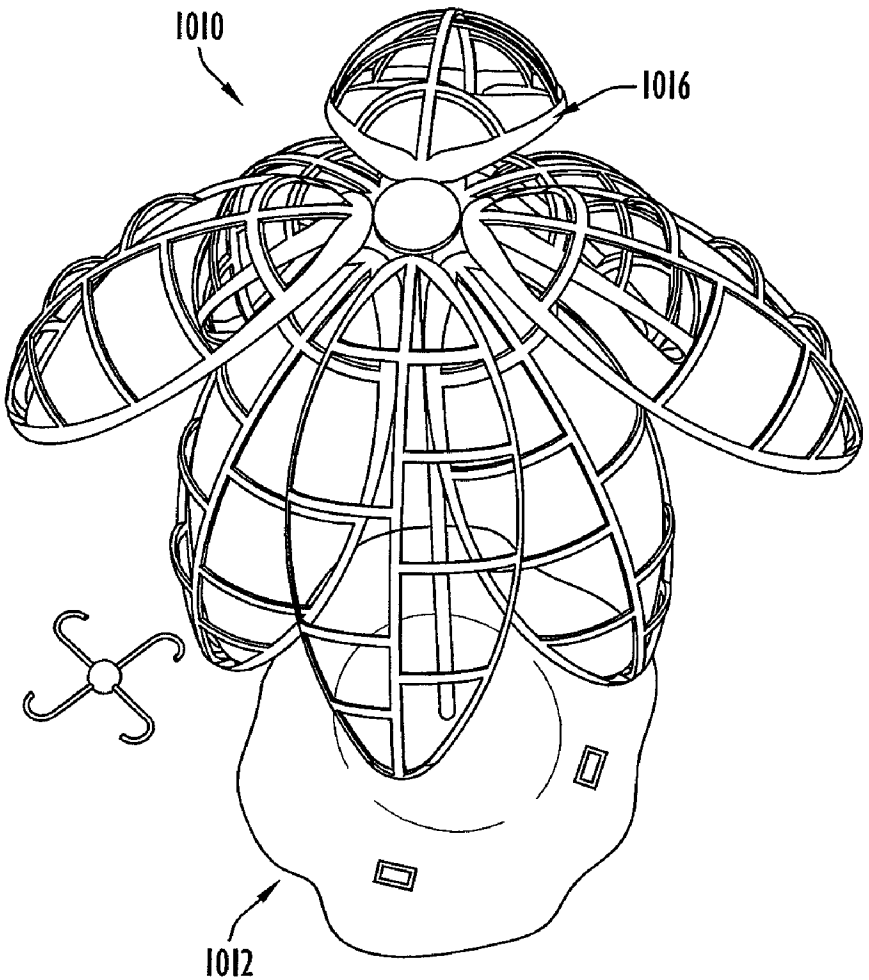
FIG. 29 is a top perspective view of a target in accordance with an embodiment of the present disclosure, showing the top of the target areas which are formed as palm tree leaves defining a plurality of apertures.

Referring now to FIGS. 29-31, there is shown another embodiment of a target 1010. In this embodiment, base 1012 is shaped as an irregular, weighted mass. Base 1012 is formed of colored plastic and provides support for the remaining elements of the target 1010. The base 1012 in this embodiment does not contain any electrical or mechanical mechanisms, but in alternative embodiments may be conformed to do so.

Shaft 1014 is formed as an elongated rod extending from base 1012, and is flexible such that when target 1010 is struck by launched projectiles 1018, both shaft 1014 and target areas 1016 may sway or otherwise move. Shaft 1014 may be formed of a material which provides support for target areas 1016, but also is flexible such that it sways or rocks when force is applied against it, thereby providing swaying or rocking motion to target areas 1016. The palm tree leaf target areas 1016 are shown defining an alternative pattern of apertures.

Target areas 1016 may also be removably attached to shaft 1014 as is shown in FIG. 30. Target areas 1016 here is attached to shaft 1014 by disposing a suction device 1034 at the apex of shaft 1014 and providing an area suitable for suction 1036 on the underside of the target areas 1016. Such an embodiment provides another connection between target areas 1016 and shaft 1014 such that target areas 1016 may bounce, shake, or sway when contact is made with target 1010.

FIGS. 21, 24-26, and 29-31 all show a plurality of projectiles 1018 having hook-like arms projecting from a body. Projectiles 1018 are formed of colored plastic and generally resemble monkeys. The arm structures on the projectiles 1018 may be of any general shape suitable to hook or latch onto an aperture. The arm structures may also include cuffs on the ends.

FIG. 32 shows an alternative embodiment of a projectile 1018 in the form of a banana. The banana projectiles 1018 are not designed to catch or snag on the tree. Rather, they are designed to hit other projectiles 1018 hanging on target areas 1016 to cause them fall off.

Figure 33:
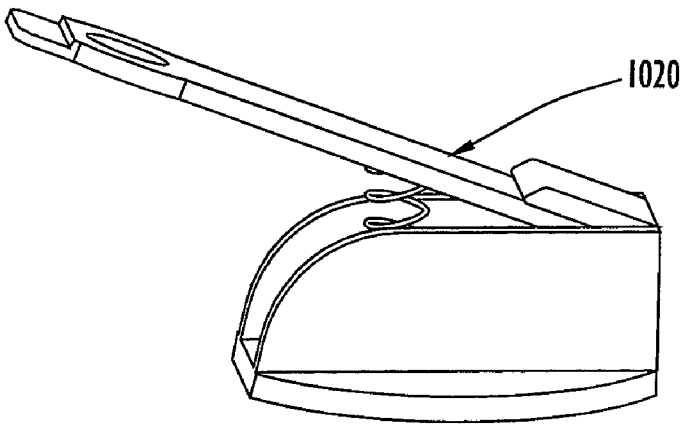
FIG. 33 is a perspective view of a launcher in accordance with an embodiment of the present disclosure, showing a spring disposed between a base and a launching board.
Figure 34:
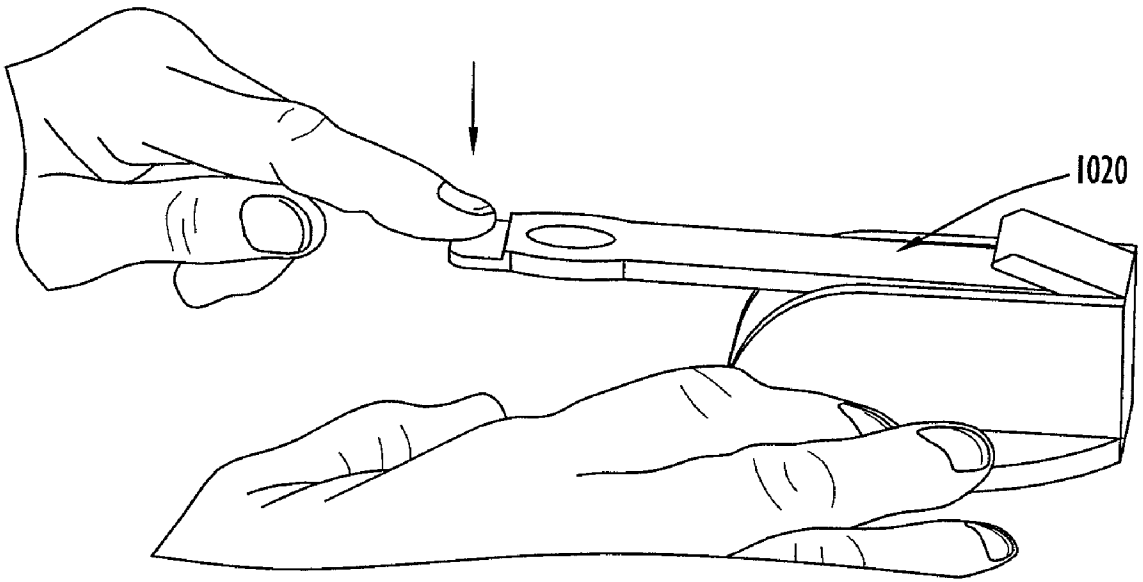
FIG. 34 is a top view of the launcher shown in FIG. 33, showing a user engaging the spring of the launcher by pressing on the launching board.

A launcher 1020 is shown in FIGS. 33-34. Launcher 1020 may have a base and a spring-loaded launching board. As shown in FIG. 34, to operate launcher 1020, force may be applied to launching board in a direction which compresses a spring, and when the force is released any object resting on launching board propelled from the apparatus. Launcher 1020 may be formed of plastic or other rigid material.

Target 1010, projectiles 1018, and launcher 1020 may be used in conjunction with one another to play games. Generally, the game requires a player to launch projectiles 1018 from a launcher 1020 at a target 1010 and specifically target areas 1016. Depending upon the goal of the particular game being played, player attempts to either snag or catch projectiles 1018 on target areas 1016 or knock off objects that are hanging from target areas 1016. The following is a non-exhaustive list of methods of using the above-described in games.

In each of the following examples, the target 1010 is in the form of a coconut palm tree; projectiles 1018 are in the form of monkeys having lengthy, hooked appendages extending from a body; and launching device 1020 resembles a pair of banana leaves. Additionally, when a second set of projectiles 1018 are implemented, they are in the shape of small bananas.

EXAMPLE ONE

Before the game begins the following must be completed: (1) set the coconut palm tree in the middle of the table; (2) divide the monkeys by color into even numbered piles; (3) each player takes a launcher 1020 and one pile of monkeys; and then (4) turn on the tree.

Gameplay then proceeds as follows: (1) all players begin launching their color of monkeys into the tree; (2) when the players have launched all of their monkeys, the game is over. The winner is the player with the most monkeys of his/her color in the tree after all players have finished shooting.

Throughout the game the coconut palm tree suddenly vibrates and makes monkey sounds while players try to launch their color of monkeys into the tree. Players will never know when the tree is going to try and shake their projectiles 1018 out of the target 1010. The game set comes with a plurality of different colors of projectiles 1018 and launching devices.

EXAMPLE TWO

Before the game begins the following must be completed: (1) set the coconut palm tree in the middle of the table; (2) divide the monkeys by color into even numbered piles; (3) each player takes a launcher 1020 and one pile of monkeys; (4) one player turns on the sounds; and (5) one player reaches in to start the tree spinning.

Once the game is ready, gameplay proceeds as follows: (1) all players begin launching their color of monkeys into the tree; (2) when the tree stops spinning, players count the number of their color of monkeys in the tree. The player with the most monkeys of his/her color wins the round.

The coconut palm tree has a hemispherical base 1012 and can spin. Throughout the game that tree sways and makes monkey sounds while players try to launch their color of monkeys into the tree.

EXAMPLE THREE

Before the game begins the following must be completed: (1) set the coconut palm tree in the middle of the table; (2) divide the monkeys by color into even numbered piles; (3) divide the bananas equally among the players; and (4) each player takes a launcher 1020, one pile of monkeys, and one pile of bananas.

Once the game is ready, gameplay proceeds as follows: (1) each player hangs their monkeys in the tree; (2) all players start launching bananas at their opponents' monkeys in the tree; and (3) the last player with a monkey in the tree wins.

In this implementation of the game, the coconut palm tree has a tree top that functions like the balancing top. When bananas land on the top if the tree they may stay on top. Additionally, the tree "trunk" is somewhat flimsy and sways or rocks side to side when hit with bananas, making some monkeys fall off the tree.

Another example of gameplay could include determining the winner via a point scale. Each leaf of the palm tree (or equivalent thereof in different embodiments) could be given a separate point value. At the completion of the game each player would add their point value to determine the winner.

A variation of any of the above examples could include a delay mechanism, such as that provided by the suction cup device in the embodiments pictured in FIGS. 27-28. For example, instead of waiting for all players to run out of monkeys to launch, the suction device could be affixed to the underlying surface immediately before play commences, and the game or round would end as soon as the suction device dislodges from the underlying surface. The player with the most monkeys on the tree at this point would win. Additionally, the delay mechanism could operate to shake or suddenly move the target upon dislodging from the underlying surface. This could be done using, among other things, a suction device and biasing mechanism wherein the biasing mechanism will abruptly jerk the tree upon release of the suction device from the underlying surface. The jerking or shaking of the tree would further operate to dislodge some of the monkeys from the tree, adding an element of chance to the game.

These examples are given as a non-exhaustive list of different methods of playing games with the structure described. Distinct aspects and features of the above-described methods of playing the game may be combined to formulate a different method.

It is believed that the disclosure set forth above encompasses multiple distinct inventions with independent utility. While each of these inventions has been disclosed in a preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where any description recites "a" or "a first" element or the equivalent thereof, such disclosure should be understood to include incorporation of one or more such elements, neither requiring nor excluding two or more such elements.

While the invention has been described in detail and with references to specific embodiments thereof, it will be apparent to one skilled in the art that various changes and modifications can be made therein without departing from the spirit and scope thereof. Thus, it is intended that the present invention covers the modifications and variations of this invention provided they come within the scope of the appended claims and their equivalents. For example, the majority of the elements can be formed of molded plastic. However, in alternative embodiments, the elements can be formed of a material other than plastic provided that the material has sufficient strength for the component's intended function.

What is claimed is:

1. A movable target game comprising:

a base;

a first movable element, the first movable element being coupled to the base for movement relative to the base in a first direction and in a second direction opposite to the first direction, the first movable element being selectively disposable in a first position and in a second position relative to the base;

a second movable element, the second movable element being coupled to the first movable element, the second movable element being movable relative to the first movable element, the second movable element being selectively disposable in its own first position and its own second position; and a drive mechanism, the drive mechanism being coupled to the first movable element, the drive mechanism being configured to cause the first movable element to move in a third direction during operation of the drive mechanism, wherein upon movement of the first movable element in the first direction causes the drive mechanism to operate, and after a period of time has elapsed, the first movable element is moved in the second direction and the movement of the first movable element in the third direction is stopped.

2. The movable target game of claim 1, wherein the first movable element has a longitudinal axis and movement of the first movable element in the third direction is rotational movement of the first movable element about its longitudinal axis.

3. The movable target game of claim 2, wherein the first movable element and the second movable element are in their respective second positions as the first movable element rotates in the third direction, and the first movable element and the second movable element move to their respective first positions after the period of time elapses.

4. The movable target game of claim 1, wherein the drive mechanism is operable when the first movable element is in its second position.

5. The movable target game of claim 4, wherein after the period of time has elapsed, the drive mechanism causes the first movable element to move along the second direction from its second position to its first position, thereby stopping movement of the first movable element and deactivating the drive mechanism.

6. The movable target game of claim 1, wherein the first movable element includes an elongate member coupled thereto, and as the first movable element moves from its second position to its first position, the elongate member engages the second movable element and causes the second movable element to move.

7. The movable target game of claim 6, wherein the first movable element includes a channel, and the elongate member is movably disposed in the channel.

8. The movable target game of claim 1, wherein the first movable element has a first end and an opposite, second end, the first movable element being coupled to the base proximate its first end, the second movable element is coupled to the first movable element at a location between the first end and the second end, the second movable element being configured to be a target, and the game further comprises:

a third element, the third element being coupled to the second end of the first movable element, the third element being configured to be a target.

9. The movable target game of claim 1, further comprising:

an object configured to be launched; and a launching mechanism, the launching mechanism being configured to be actuated to impart motion to the object, wherein the second movable element is configured to be a target for the object and to retain the object thereon.

10. The movable target game of claim 9, wherein the first movable element includes a target area that defines a plurality of openings, the second movable element includes a target area that defines a plurality of openings, and the object is configured to engage at least one opening of the first movable element target area or at least one opening of the second movable element target area.

11. The movable target game of claim 9, wherein the object includes a body and at least one arm portion extending outwardly therefrom, and the second movable element includes a target area that defines a plurality of openings, the at least one arm portion releasably receivable in any one of the plurality of openings.

12. The movable target game of claim 1, wherein the first movable element is automatically moved in the second direction upon expiration of the period of time.

13. The movable target game of claim 1, wherein the first movable element is engaged with the drive mechanism when disposed in the first position, and the first movable element is disengaged from the drive mechanism when disposed in the second position.

14. The movable target game of claim 1, wherein the second movable element includes a target area having a body portion, a perimeter member extending between opposing end portions of the body portion, and a plurality of bars extending between the body portion and the perimeter member and defining a plurality of openings.

15. The movable target game of claim 14, further comprising an object configured to be launched at the target area, the object including a hooked member receivable in any one of the plurality of openings so that the object is releasably coupleable to the target area.

16. The movable target game of claim 1, wherein the second movable element includes a body portion with a proximal end and a distal end, the proximal end being movably coupled to the first movable element, the body portion including a perimeter member extending between the proximal end and the distal end and defining the sides of the body portion, the body portion also including at least one rib extending between the perimeter member and defining at least two openings in the body portion, each of the openings being configured to receive a portion of an object that is launched at the second movable element.

17. A device for a target game comprising:

a base;

a support member, the support member being coupled to the base for movement relative thereto, the support member including a target area; and a drive mechanism, the drive mechanism being coupled to the support member to move the support member relative to the base, the drive mechanism being activated in response to movement of the support member along a first direction toward the base, the drive mechanism being configured to operate for a period of time, and after the period of time to move the support member in a second direction has elapsed, the drive mechanism moves the support member along a third direction away from the base and the drive mechanism is deactivated.

18. The device of claim 17, wherein the support member includes a longitudinal axis, and the support member is coupled to the base so that the support member rotates relative to the base around its longitudinal axis.

19. The device of claim 17, wherein the target area is a first target area, the support member includes a second target area, and one of the first target area and the second target area is coupled to the support member for movement relative to the support member.

20. The device of claim 17, wherein the drive mechanism automatically moves the support member along the direction away from the base upon expiration of the period of time.

21. The device of claim 17, wherein the support member is disposable in a first position in engagement with the drive mechanism and a second position in disengagement from the drive mechanism, the support member is moved into the first position when moved toward the base, and the support member is moved into the second position when moved away from the base.

22. The device of claim 17, wherein the support member includes a longitudinal axis, the target area being a first target area, further including a second target area, the first and second target areas being axially spaced along the longitudinal axis of the support member.

23. The device of claim 17, further comprising:

a projectile configured to be launched at the target area, the target area defining a plurality of openings, at least a portion of the projectile releasably receivable in any one of the plurality of openings.

24. The device of claim 17, wherein the target area includes a body portion with a proximal end and a distal end, the proximal end being coupled to the support member, the body portion including a perimeter member extending between the proximal end and the distal end and defining the sides of the body portion, the body portion also including at least one rib extending between the perimeter member and defining at least two openings in the body portion, each of the openings being configured to receive a portion of an object that is launched at the target area.

25. The device of claim 17, wherein the support member includes a longitudinal axis, the target area being a first target area, and the device further includes a second target area, the first and second target areas being axially spaced along the longitudinal axis of the support member, each of the target areas defining a plurality of openings therein.

26. The device of claim 17, wherein the support member is operably coupled to the drive mechanism when the support member has been moved toward the base, and the support member is disengaged from the drive mechanism when the support member is moved away from the base.

27. A toy launching game comprising:

a target assembly including a base, a support, a drive mechanism coupled to the support, and a target area, the target assembly being disposable in a first configuration and in a second configuration different from the first configuration, the support being movable relative to the base in a first direction, in a second direction, and in a third direction, wherein movement of the support in the first direction activates the drive mechanism, and the drive mechanism causes the support to rotate in the third direction;

an object configured to engage the target area; and a launching mechanism, the launching mechanism being configured to propel the object toward the target assembly as the target assembly moves in the third direction.

28. The toy launching game of claim 27, wherein the first direction is toward the base and the second direction is away from the base.

29. The toy launching game of claim 28, wherein the support includes a longitudinal axis, and the movement of the support in the third direction includes rotation of the support substantially about the longitudinal axis.

30. The toy launching game of claim 27, wherein the support is movable relative to the base in the first direction from its first configuration to its second configuration, in the second direction from its second configuration to its first configuration, and in the third direction while the support is in its second configuration.

31. The toy launching game of claim 27, wherein movement of the support in the second direction deactivates the drive mechanism, thereby stopping rotation of the support.

32. The toy launching game of claim 27, wherein as the target assembly moves along the first direction, the target assembly changes from its first configuration to its second configuration, the target assembly being movable in the third direction while the target assembly is in its second configuration.

33. The toy launching game of claim 32, wherein as the target assembly moves along the second direction, the target assembly changes from its second configuration to its first configuration, and the target assembly ceases movement in the third direction.

34. The toy launching game of claim 33, wherein the drive mechanism is activated when the target assembly is in its second configuration, and the drive mechanism is deactivated when the target assembly is in its first configuration.

35. The toy launching game of claim 34, wherein the drive mechanism is configured to move the target assembly from its second configuration to its first configuration after the target assembly has been in its second configuration for a certain period of time.

36. The toy launching game of claim 27, wherein the target area moves relative to the support as the support moves in the first direction and as the support moves in the second direction.

37. The toy launching game of claim 36, wherein the target area moves with the support as the support moves in the third direction.

38. The launching game of claim 27, wherein the target area defines a plurality of openings, the object includes an arm receivable in any one of the plurality of openings, and the target area includes a body portion and a plurality of ribs extending outwardly from the body portion and defining the plurality of openings.

* * * * *